US012102148B2

(12) United States Patent
Albers et al.

(10) Patent No.: US 12,102,148 B2
(45) Date of Patent: Oct. 1, 2024

(54) ARTS UNIFORM AND COSTUME GARMENT

(71) Applicant: TAGG APPAREL LLC, Fort Myers, FL (US)

(72) Inventors: Barbara Albers, Fort Myers, FL (US); Sally Rojas Herrera, Sugar Land, TX (US); Carolina Phinney, Fort Myers, FL (US); Marialexandra Garcia, Palmetto Bay, FL (US)

(73) Assignee: TAGG APPAREL LLC, Fort Myers, FL (US)

( * ) Notice: Subject to any disclaimer, the term of this patent is extended or adjusted under 35 U.S.C. 154(b) by 534 days.

(21) Appl. No.: 17/251,389

(22) PCT Filed: Jun. 11, 2019

(86) PCT No.: PCT/US2019/036591
§ 371 (c)(1),
(2) Date: Dec. 11, 2020

(87) PCT Pub. No.: WO2019/241277
PCT Pub. Date: Dec. 19, 2019

(65) Prior Publication Data

US 2021/0251321 A1 Aug. 19, 2021

Related U.S. Application Data

(60) Provisional application No. 62/683,338, filed on Jun. 11, 2018.

(51) Int. Cl.
*A41D 27/24* (2006.01)
*A41B 11/01* (2006.01)
(Continued)

(52) U.S. Cl.
CPC ..... *A41D 27/24* (2013.01); *A41B 11/01* (2013.01); *A41B 11/14* (2013.01); *A41D 1/08* (2013.01);
(Continued)

(58) Field of Classification Search
CPC ..... A41B 11/01; A41B 11/14; A41B 11/02; A41B 11/04; A41B 11/08; A41B 11/005
See application file for complete search history.

(56) References Cited

U.S. PATENT DOCUMENTS 1,075,864 A * 10/1913 Scott ..... A41B 11/00 66/187
2,687,525 A * 8/1954 Rutledge ..... A41C 1/003 2/407
(Continued)

FOREIGN PATENT DOCUMENTS

CN 105614971 A 6/2016
JP 2016199820 A * 12/2016

OTHER PUBLICATIONS

Maman Loup's Den. "How Reusable Panty Liners Are Still Helping Me Save After 3 Years". URL="https://mamanloupsden.com/2016/08/11/reusable-panty-liners/" . Accessed Aug. 22, 2023. (Year: 2016).*
(Continued)

*Primary Examiner* — Jameson D Collier
(74) *Attorney, Agent, or Firm* — SALIWANCHIK, LLOYD & EISENSCHENK

(57) ABSTRACT

Embodiments of the present invention relate to the arts garment, and, in particular, ballet tights for adults and adolescents for use during classes, rehearsals, and performances. The subject tights offer a redesign of the existing waistband by one or more of, and preferably all of, the following: removing the elastic component of the traditional waistband, and Nylon the use of flat and thinner seams, extra
(Continued)

soft yarn with a tight knit weave, a V-shape seam to follow the natural female pelvic structure, a crotch size to fit most, if not all, vagina shapes and sizes, a double layer moisture wicking built-in underwear with G-string and a full back in the rear, and appropriate cut outs on the bottom of foot.

51 Claims, 24 Drawing Sheets

(51) Int. Cl.
*A41B 11/14* (2006.01)
*A41D 1/08* (2018.01)
*A41D 31/18* (2019.01)

(52) U.S. Cl.
CPC ..... *A41D 31/18* (2019.02); *A41D 2300/50* (2013.01)

(56) References Cited

U.S. PATENT DOCUMENTS 3,306,081 A 2/1967 Miles et al.
4,101,982 A * 7/1978 Muller ..... A41B 11/14 2/408
5,651,779 A * 7/1997 Burrell ..... A61F 13/72 2/401
5,987,933 A 11/1999 Metzler
6,170,089 B1 * 1/2001 Marchetti ..... A41B 11/14 2/239
6,247,182 B1 * 6/2001 Tasbas ..... A43B 17/00 2/239
6,725,691 B2 * 4/2004 Yakopson ..... D02G 3/328 66/178 R
7,007,309 B1 * 3/2006 Mende ..... A41B 11/14 2/409
7,260,961 B1 * 8/2007 Kennedy ..... D04B 1/243 66/171
7,895,863 B2 3/2011 Smith et al.
2014/0090273 A1 * 4/2014 Piontkowski ..... A43B 7/1435 36/44
2015/0074872 A1 * 3/2015 Seawell ..... D04B 1/106 2/242
2018/0002839 A1 1/2018 Liao et al.

OTHER PUBLICATIONS

Olive Knits. It's Not You, It's Me: Class Notes. URL = "https://www.oliveknits.com/wp-content/uploads/2017/05/Its-Not-You-Its-Me-Class-File-2.pdf". Accessed Aug. 22, 2023. (Year: 2017).*
English machine translation of JP 2016199820 A. Via Clarivate Analytics on FIT database in PE2E Search. (Year: 2016).*

* cited by examiner

| MEASUREMENTS (CM) AT REST ($X_R$) | | | | | | |
|---|---|---|---|---|---|---|
| Measurement Area | XS | S | M | L | XL | Tolerance |
| $A_R$: Waist Width | 23 | 24 | 25 | 26 | 27 | +/- 1 |
| $B_R$: Waist Height | 5 | 5.5 | 6 | 6.5 | 7 | +/- 1 |
| $C_R$: Front Panty Width at Waist | 9 | 10 | 11 | 12 | 13 | +/- 1 |
| $D_R$: Front Panty Width at Crotch | 4 | 4 | 4 | 4 | 4 | +/- 1 |
| $E_R$: Front Panty Height | 24 | 25 | 26 | 27 | 28 | +/- 1 |
| $F_R$: Back G-String Center Seam | 9 | 10 | 11 | 12 | 13 | +/- 1 |
| $G_R$: Back Cheeky Width at Waist | 9 | 10 | 11 | 12 | 13 | +/- 1 |
| $H_R$: Back Cheeky Height | 12 | 13 | 14 | 15 | 16 | +/- 1 |
| $I_R$: Back Cheeky Width at end of Crotch | 2 | 2 | 2 | 2 | 2 | +/- 0.5 |

| MEASUREMENTS (CM) ELONGATED ($X_E$) | | | | | | | |
|---|---|---|---|---|---|---|---|
| Measurement Area | XS | S | M | L | XL | Tolerance | Elongation % |
| $A_E$: Waist Width | 55 | 56 | 59 | 61 | 62 | +/- 3 | 3% |
| $B_E$: Hip Width | 68 | 70 | 72 | 74 | 76 | +/- 3 | 3% |
| $C_E$: & $G_E$: Not measured as an individual item | N/A | N/A | N/A | N/A | N/A | N/A | N/A |
| $E_E$: & $F_E$: & $H_E$: Not measured as an individual item | N/A | N/A | N/A | N/A | N/A | N/A | N/A |

| MEASUREMENTS (CM) AT REST ($X_R$) | | | | | | |
|---|---|---|---|---|---|---|
| Measurement Area | XS | S | M | L | XL | Tolerance |
| $A_R$: Hip Width | 7.6 | 7.8 | 8 | 8.2 | 8.4 | +/- 2 |
| $B_R$: Leg Width | 7.6 | 7.8 | 8 | 8.2 | 8.4 | +/- 2 |
| $C_R$: Foot Width | 7.1 | 7.3 | 7.5 | 7.7 | 7.9 | +/- 2 |
| $D_R$: Upper Tights Length (where panty will be sewn) | 16 | 16.5 | 17 | 17.5 | 18 | +/- 5 |
| $E_R$: Leg Length | 76 | 77 | 78 | 79 | 80 | +/- 5 |

| MEASUREMENTS (CM) ELONGATED ($X_E$) | | | | | | | |
|---|---|---|---|---|---|---|---|
| Measurement Area | XS | S | M | L | XL | Tolerance | Elongation % |
| $A_E$: Hip Width | 42 | 44 | 46 | 48 | 50 | +/- 2 | 3.0% |
| $B_E$: Leg Width | 42 | 44 | 46 | 48 | 50 | +/- 2 | 3.0% |
| $C_E$: Foot Width | 31 | 32 | 33 | 34 | 35 | +/- 1 | 3.0% |
| $D_E$: Panty Length | 70 | 75 | 80 | 85 | 90 | +/- 4 | 2.0% |
| $E_E$: Leg Length | 224 | 234 | 244 | 254 | 264 | +/- 4 | 4.0% |

| MEASUREMENTS (CM) AT REST ($X_R$) | | | | | | | |
|---|---|---|---|---|---|---|---|
| | Measurement Area | XS | S | M | L | XL | Tolerance |
| Tights | $A_R$: Panty Width at Waist | 14 | 15 | 16 | 17 | 18 | +/- 1 |
| | $B_R$: Panty Center Length (Proximal to Distal) | 15 | 16 | 17 | 18 | 19 | +/- 1 |
| | | | | | | | |
| PUL | $D_R$: Panty Width at Waist | 14 | 15 | 16 | 17 | 18 | +/- 1 |
| | $E_R$: Panty Center Length (Proximal to Distal) | 15 | 16 | 17 | 18 | 19 | +/- 1 |
| | | | | | | | |
| Cotton | $G_R$: Panty Width at Waist | 14 | 15 | 16 | 17 | 18 | +/- 1 |
| | $H_R$: Panty Center Length (Proximal to Distal) | 15 | 16 | 17 | 18 | 19 | +/- 1 |
| | | | | | | | |

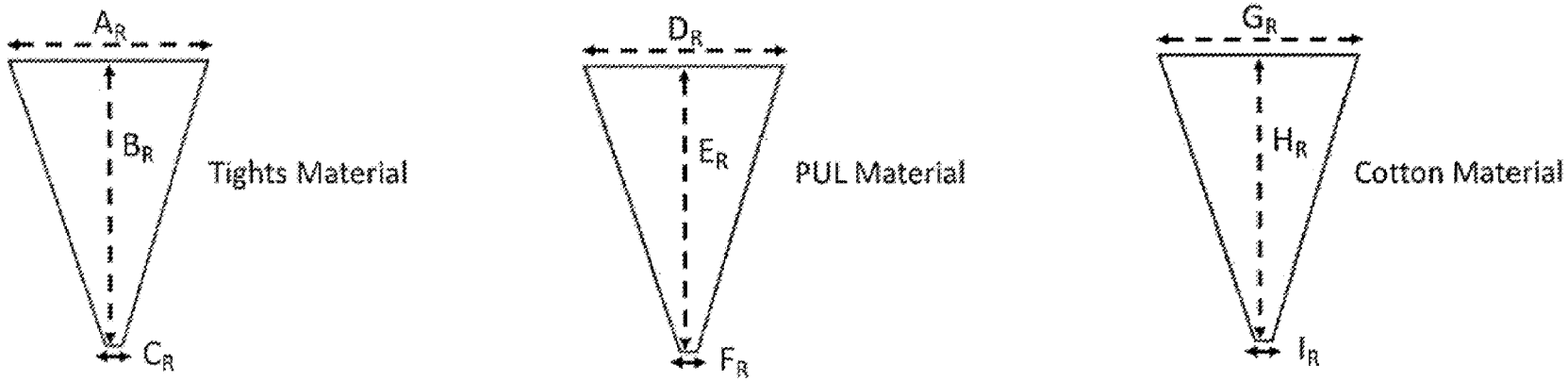

| MEASUREMENTS (CM) AT REST ($X_R$) | | | | | | | |
|---|---|---|---|---|---|---|---|
| | Measurement Area | XS | S | M | L | XL | Tolerance |
| Tights | $A_R$: Panty Width at Waist | 14 | 15 | 16 | 17 | 18 | +/- 1 |
| | $B_R$: Panty Center Length (Proximal to Distal) | 16 | 16.5 | 17 | 17.5 | 18 | +/- 1 |
| | $C_R$: Front Panty/Back Cheeky Width at Crotch | 2 | 2 | 2 | 2 | 2 | +/- 0.5 |
| PUL | $D_R$: Panty Width at Waist | 14 | 15 | 16 | 17 | 18 | +/- 1 |
| | $E_R$: Panty Center Length (Proximal to Distal) | 16 | 16.5 | 17 | 17.5 | 18 | +/- 1 |
| | $F_R$: Front Panty/Back Cheeky Width at Crotch | 2 | 2 | 2 | 2 | 2 | +/- 0.5 |
| Cotton | $G_R$: Panty Width at Waist | 14 | 15 | 16 | 17 | 18 | +/- 1 |
| | $H_R$: Panty Center Length (Proximal to Distal) | 16 | 16.5 | 17 | 17.5 | 18 | +/- 1 |
| | $I_R$: Front Panty/Back Cheeky Width at Crotch | 2 | 2 | 2 | 2 | 2 | +/- 0.5 |

FIG. 13

ARTS UNIFORM AND COSTUME GARMENT

CROSS REFERENCE TO RELATED APPLICATIONS

This application is a National Stage Application of International Application Number PCT/US2019/036591, filed Jun. 11, 2019; which claims the benefit of U.S. Provisional Application Ser. No. 62/683,338, filed Jun. 11, 2018, both of which are incorporated herein by reference.

TECHNICAL FIELD

Embodiments of the present invention relate to the arts garment, and, in particular, ballet tights for female adults and female adolescents for use during classes, rehearsals, and performances. The subject tights offer a redesign of the existing garment by one or more of, and preferably all of, the following: the use of specially designed yarn in the fabrication of the applied seams and weaves; the use of flat and thinner seams; the use of a specially designed seam in the G-String option; the use of four different weaves/knits for a) the tights fabric, b) the reinforced tights fabric, c) the waistband fabric and d) the reinforced weave used in the toe area of the foot; a V-shape panty assembly including flat seams that follows the natural female pelvic structure for more comfort and coverage than traditional tights and that captures and wicks moisture through a multi-layered crotch-area construction designed to fit most, if not all, female groin, crotch and genitalia shapes and sizes; a wider waistband that eliminates the elastic component of the traditional waistband; the use of a specially designed back panel in the Cheeky option; the shaping of the foot portion of the tights to follow the curvature of the toes; the use of a thinner flat seam in the toe portion of the foot; and cut-outs on the ball of the foot and heel for greater traction, comfort and safety; and a color selection that provides the right amount of opacity for demonstrated muscle definition, the retention of tight color and the uniformity of leg color under stage lights regardless of the skin tone of the wearer.

BACKGROUND OF INVENTION

Ballet garments used in the past, specifically with regards to ballet tights, have primarily used the same weave and fabric for the entire garment, including the pelvic and crotch areas (or trunk portion), the waist, the legs, and the foot. Previous patents have described improvements to some areas. However, as a whole product, existing ballet garments do not provide the basic comfort, protection, and performance required for today's female ballet dancer. U.S. Pat. No. 3,212,103 discloses an improvement at the underside of the foot portion of a ballet garment, which comprises an opening slightly smaller than the foot size of garment, and includes a lightly padded panel sewn to that opening, thus eliminating the seam running through the center of the underfoot. However, this design does not allow for easy and quick access to the dancer's toes, without completely undressing, to apply bandages, band aides, toe pads, or other items that are the necessities of a ballet dancer. Nor does this design address the pain and blistering caused by the bunching of material at and around the toes, nor does it address the pain and blistering caused by poorly placed and bulky seams, nor does it address the need for traction required under the foot for better articulation of the foot.

None of the prior art, including U.S. Pat. No. 3,212,103, discloses any improvements to the waistband that can add more comfort and improve the appearance of the desired waistline of the dancer. Nor does any prior art include an improvement with respect to the weave of the waistband fabric. Nor does any prior art include the location of seams and the thickness of the seams, such as to add to the comfort of the dancer and/or eliminate unwanted body-contour visual effects.

No prior art incorporates a crotch portion that has moisture-capture and moisture-wicking properties, so as to provide protection needed as a result of natural female bodily functions, such that dancers can sacrifice their comfort, aesthetics, hygiene, and basic dignity, thus changing the quality of performance of a dancer.

None of the prior art discloses an improvement in the weave of fabric that would provide 10 more flexibility, comfort, compression-like support and durability against wear and tear.

No prior art discloses the necessity for the inclusion of colors and opacity that can improve the aesthetics and uniformity-of-appearance on stage, in light of ballet becoming universally more multi-racial and including dancers of all races and colors. The use of the ballet tights by dancers of various skin colors has not been taken into account, such that the fact that the color of skin under the garment can significantly change the perceived color and, thus, change the appearance of the garment, even more so, under stage lights, has not been addressed.

BRIEF SUMMARY

Throughout the history of ballet tights as a garment in the form of a uniform and/or a costume, little to no consideration has been given to the comfort, fit, or performance of the female dancer other than the basic utility of covering the leg. Additionally, there has never been any consideration given to providing the basic necessities associated with the bodily functions or anatomy of the typical female dancer. Embodiments of the present invention address multiple issues associated with the current garments available in the market, and improve the utility of many components of the garments utilized by female dancers today.

Embodiments of the subject invention, which can be referred to as CORSU Tights, utilize a yarn that is softer, more flexible, and more durable than yarn used in currently available ballet tights. The use of this yarn can increase the softness, flexibility, and durability of the ballet tights, and of the seams incorporated in to the garment, allowing for increased freedom of movement and reduced friction between garment and skin that maximizes comfort essential to a dancer. Additionally, the use of this yarn prevents the fabric from bunching when pinched and slows the effects of common wear and tear that are associated with currently available garments. Various combinations of Spandex, Nylon, and Cotton can be used. The nylon used to create the yarn can be nylon typically used in clothing, such as nylon 6,6; nylon 6/6; or other nylon as desired.

Embodiments of the CORSU Tights can utilize an extra soft yarn (schematically illustrated in FIG. 1) to create specially designed weaves such as a Weft Jersey Knit (or Circular Continuous Weave), schematically illustrated in FIG. 2A, for use in the tights material, a 1×3 Rib Knit, schematically illustrated in FIG. 2B, for use in the Waistband (1×1, 1×2, or 1×4 Rib Knit can also be used), a first reinforced weave with 1×1 rib knit, such as shown in FIG. 2C, to offer the dancer a compression-like effect in parts of the tights such as the portion of the rights seemed to the waistband without compromising the elasticity and comfort and a second reinforced weave with a 1×1 rib knit, such as shown in FIG. 2D, for use in the toe area of the foot. In further embodiments, the waistband can incorporate a 1×2 or 1×4 rib knit. A panty reinforcement weave with a 1×1 rib knit can be used adjacent the panty panel (See FIGS. 7A and 8B). Preferably, all of the reinforcement weaves use the same yarn as the tights weave, but different yarn can be used for one or more reinforcement weaves.

Embodiments of the CORSU Tights can utilize considerably thinner and flatter seams. These seams, such as shown in FIGS. 3A through 3D add additional comfort to the wearer and are less visible to the audience, creating cleaner more natural lines. Additionally, a G-String seam, such as shown in FIG. 3E can be used to shape and lift the buttocks.

Additionally, embodiments of the CORSU Tights locate the seams on the sides of the generally V-shape panty panel of the tights, as shown in FIG. 4A, to mirror the female anatomy. In an embodiment, the center seam that causes unwanted body-contour visual effects in typical tights (commonly known as "camel-toe") is replaced with a generally V-shaped panel (panty panel or crotch panel) where seams are located at the sides panty panel (see FIGS. 4A, 6A, 7A and 7B) eliminating the uncomfortable, unsightly and embarrassing effect caused by the center seam in currently available tights. The panty panel also covers an area that is the size of most women's groin, crotch, or vaginal region. In an embodiment, the V-shaped panel and location of the seams in the front of the tights follows the natural shape of female genitalia, alleviating the need for the dancer to don an additional layer (trunk) for modesty during rehearsal (uniform) and performance (costume).

In a preferred embodiment, the subject tights for female dancers incorporate one or two additional layers in the crotch area of the panty that will absorb discharges naturally secreted by female dancers (FIG. 6A). The first layer (wicking cotton/polyester mix) lying closest to the body acts as a necessary gusset that absorbs discharge (natural discharge, menstrual cycle discharge, and/or urine, etc.). The absorbent first layer can incorporate cotton, such as a cotton/polyester mix having 20%-80% cotton and 80%-20% polyester, respectively, or 80%-100% cotton, as desired. The absorbent first layer can be from other materials, such as 95% cotton and 5% spandex. This absorptive function can diminish the risk of infections due to sweat, moisture, and/or secretion. An optional second layer (e.g., made of a polyurethane or a polyurethane laminate commonly known as PUL) prevents leakage, thereby eliminating unsightly and embarrassing moisture stains on outer garments. Other moisture blocking material can also be used, such as cellulose used in diapers. Another version of this construction could allow for a built-in pocket for dancers to add additional protection of their choice (FIG. 8). This construction of the groin area of the panty in accordance with the subject tights allows for increased comfort, better range of motion, modesty, and peace of mind. The Panty provides at least some of the benefit of adult female underwear and greatly reduces lines that are visible to an audience without having to resort to an extra garment. This design also satisfies the typical current mandate by instructors and dance companies of "no underwear allowed" while in uniform or costume.

Embodiments of the present invention incorporate various back panel cuts to the rear of the groin area of the female tights. Embodiments include the G-string (Option 1) (FIGS. 3D, 4C, 4D, 5A, 7A and 10B) and the Cheeky (Option 2) (FIGS. 4E, 4F, 5B, 7B and 10B).

The G-String (Option 1) closely resembles adult female underwear and greatly reduces lines. The Zig-Zag stitching (FIG. 3D) provides an uplifting buttocks shape. The Zig-Zag stitching can form angles with the axis of the seam in the range of 30°-60°, 35°-55°, 40°-50°, 49°-47°, and/or 44°-46°. In a specific embodiment, the Zig-Zag weave is about 7 mm wide and reduces to 6 mm wide when worn by the dancer.

The Cheeky (Option 2) more closely resembles full back panties. This embodiment of the tights, while available for adults, serves well as an alternative for female adolescents and can also satisfy common uniform/costume mandates.

Embodiments of the subject tights address the discomfort and unwanted side-effects of the current waistband employed in tights by removing a portion of the elastic element of the waistband, thereby creating a better fit and more comfort, taking into consideration the average waistline of a female. Embodiments of the subject tights extend the height of the waistband by 1-4 inches, and/or by 1 cm to 12 cm, compared to waistbands of typical tights. This provides hold and support without restricting movement, natural breathing, and/or circulation.

Embodiments change the areas of the traditional cut-out in the foot area of current market options, and provide underfoot cut-outs in one or more areas that allow the dancer sufficient traction to fully articulate the foot within a pointe shoe (FIGS. 9A and 9B). Embodiments expand the bottom of the foot opening to include the ball of the dancer's foot and add a cut-out at the heel to further reduce slipping inside the pointe shoe. This can also reduce painful blistering that can lead to infections.

Embodiments include a tights foot design that follows the curvature of the toes and is not square as in garments currently available (FIG. 9B). Embodiments include a reinforced weave used in the toe area of the foot for greater comfort, increased toe traction, and slowed wear and tear (FIGS. 9A and 9B). Embodiments utilize a flat seam for additional comfort in this toe area and a second reinforcement weave (FIG. 2D) for additional support as this area of the tights sustains hours of pounding and pressure endured on a daily basis.

Embodiments of the subject tights address the universal need for additional colors, shades and opacities that improve the aesthetics and uniformity-of-appearance on stage and in studio, taking into account dancers of all skin colors. This feature will be realized through the use of special dyes to create custom shades that can significantly affect the color under stage lights. Each shade will give options yet to be offered in the current market to dancers, companies and studios alike. This will further broaden diversity and improve inclusion within the dance community.

In essence, CORSU Tights embody all the advantages of modern technology and incorporate essential elements that will meet the needs of companies, studios and dancers alike. 20 CORSU Tights is a garment that offers a combination of comfort, utility, aesthetics and performance not available in today's market.

BRIEF DESCRIPTION OF DRAWINGS

FIG. 13 shows diagrams representing the panty portion of the Cheeky (Option 2) at rest measurements of a garment in accordance with embodiments of the subject invention, where elongated measurements are not provided because the panty layers are not meant to be used on their own or to be stretched when worn during use.

DETAILED DISCLOSURE

Figure 1:
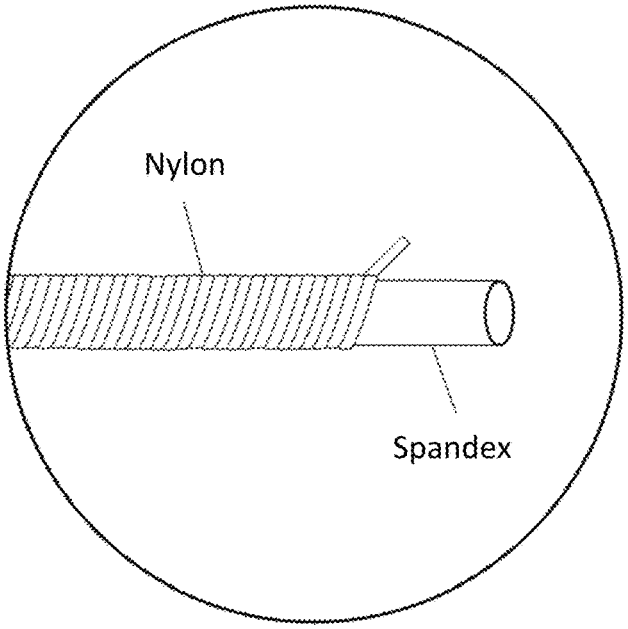
FIG. 1 shows an embodiment of a yarn that can be incorporated with a garment in 25 accordance with embodiments of the subject invention.

Ballet tights, as they are called now, have been worn since the 1600's, as gentlemen used them for "Court Dress." It is this social court dress custom that formed the basis for ballet and dance costumes that has now become tradition. Court dress was quite complex, involving materials that were heavy and cumbersome.

The weight and multiple layers of court dress restricted the ability for movement. Ladies were mandated to cover their legs entirely, so that only their ankles were visible, by wearing stockings followed by layers of petticoat and hooped farthingale, and finally their dress.

As ballet/dance advanced, so did the need for better costumes and uniforms. Dancers improved their technique and precision necessitating that uniforms and costumes allow audiences a more complete view in order to appreciate dancers' ever more intricate footwork. Teachers began to require the use of ballet tights as part of their uniform during daily instruction, a tradition that continues today. This permits instructors the ability to view the dancers' legs and feet in order to correct any flaws in their technique.

Dance skills and technique continued to develop and required more freedom of movement without the constrictions of the traditional court dress. Ballet/dance tights became thinner and less constricting with the invention of materials that could stretch more, such as elastane (Spandex). These materials have been widely used for ballet tights for years, however not at an optimal composition or mix, keeping the classical ideals and the need for cleaner, more natural leg lines, to achieve uniformity of appearance on stage and in the classroom. The desired effect of sheer tights continues the tradition of uniformity on stage and in studio, while displaying the muscles derived from the physicality of being a proficient dancer. The demand for maximum freedom and range of motion is a requisite, while supporting the dancers with modern technologies that enhance endurance and foster career longevity. Confidence is of paramount importance. Technology and new materials can be used to give the dancers greater confidence that can lift them to new levels never before achieved. Despite these advances in dance skills and materials, there continues to be little to no advancement of female tights construction and design.

Today, with technique matching that of an elite athlete, the necessity is growing for tights that are made specifically for the female dancer. Needed are more advanced female ballet/dance tights that allow for a greater range of movement, produce more flexibility and durability and greater comfort while protecting and supporting certain body parts and that cover female dancers' genitalia more effectively and comfortably while maintaining the dancers' dignity and confidence.

Choreography is sharper, increasingly more complex and more demanding than ever before. Dancers are in the studios longer hours refining and perfecting their skills. Due to societal changes, ballet dancers no longer have a need for modesty except for the coverage of the genitalia area. Instead, audiences want to see the dancer's hard earned muscle definition and dancers want to maximize their lines while showing their toned bodies on stage. They want the appearance of classical lines as before, but with modern technologies that allow their strength, proficiency, power and endurance to be displayed visually and admired by wide audiences and peers alike, but while still maintaining a certain level of reserve and modesty.

Along with the need for tights to better facilitate a female dancer's technique while maintaining her dignity, is the desired comfort and biological need for a panty assembly that includes a crotch construction specifically designed for the female anatomy and the realities of daily female bodily functions including menstrual cycles. Currently in the market, manufacturers incorporate a gusset that is too small into their tights and use the same weave for the tights and the crotch area. Additionally, current tights incorporate a seam down the center of the tights with a small oval shape (in the same tights material or a cotton mix) sewn into the crotch that results in uncomfortable vaginal/anal pressure and does not meet the need of aesthetics, comfort, or function. There is a need for additional layers of material located at the crotch area that does not inhibit or restrict dance movement and that absorbs and wicks moisture and natural female discharge in order to maintain hygiene and prevent leaks. Without this, the sweat and natural discharge can be seen when a dancer extends her leg. These undesired effects are remedied by thoughtful placement of a generally V-shaped panty in accordance with embodiments of the subject invention that include protective layers in the crotch area, with flat seams along the edges to match the natural shape of a woman's anatomy. Further, this thoughtful assembly allows compliance with instructor and dance company rules that prohibit dancers from wearing underwear under their tights while in uniform or costume. Additionally, embodiments facilitate adherence to the desire for uniformity-of-appearance that can be destroyed by visual lines created by undergarments or the garment themselves. Unfortunately, with garments currently available in the market today, compliance with this mandate comes at the cost of the dancers' comfort and modesty.

Currently available tights utilize yarns and weaves that are rough to the touch leading to itchiness and irritability for the dancer. They also are fabricated with non-circular weaves that leads to easily incurred snags, tears, rips and runs that result in low durability and short life spans for these tights. The weaves also do not have the stretch necessary to allow a maximum range of motion while maintaining compression-like support. Additionally, the weaves do not return to their normal shape after pinching the material as is often done when manually adjusting the tights while being worn. Current tights do not incorporate additional reinforced weaves to the areas where a dancer stretches their bodies most, hence the tights do not stretch as much as they should in these areas. In addition, current tights do not come in a range of colors and opacity which leads to a lack of uniformity in appearance due to varying skin tones. Professional productions require this uniformity-of-coloring for performances and are unable to achieve this with currently available tights. The use of softer yarn, more thoughtful weave patterns in different parts of the garment and customized opacities and dying processes and color choices would significantly improve these deficiencies. Due to lack of proper opacity levels, dancer's muscle definition is not sufficiently shown through the tights. Lastly, the vibrancy of colors offered are lost under stage lights as well as the variation of color choices relative to skin tones does not allow the uniformity of leg colors under performance lights.

Currently available tights use seam fabrication, seam size and seam placement that result in discomfort to the dancer, visible unwanted body-contour lines and visible unwanted garment lines that create unsightly, embarrassing and often compromising visuals to instructors and audiences while practicing and performing. Thoughtful construction, sizing, and placement of seams significantly improve these deficiencies.

Currently available tights have waistbands that are made from a thin strip of elastic that due to poor design inflicts significant pain and discomfort to dancers so much so that many of them cut slits in the elastic waistband to reduce the tightness of the elastic around the waist. Introducing a re-designed waistband that fits most dancers, provides additional torso support and eliminates unnecessary discomfort by removing the elastic component of the traditional tights thus improving the female dancers' experience. The subject design offers more freedom of movement and eliminates unwanted stomach bulge (often referred to as muffin-top).

Currently available tights have only one cut-out at the bottom of the foot. There are no tights in the market that have a cut-out in the heel area. The current tights cause a lack of grip from heel to the shoe causing the dancer to over pull the drawstring to tighten the pointe shoe. This leads to increased blistering and discomfort/pain. In order for a dancer's heel to not slip off the shoe, dancers wearing typical tights often tighten the draw string of the shoe too tightly, causing blisters and pain. In addition, dancers use rosin to add traction inside the pointe shoe where, if it comes in contact with an open sore, it can lead to a severe infection needing immediate medical attention. Additionally, currently available tights include foot portions that are squared at the distal ends, which bunch, and incorporate heavy protruding seams, both of which cause pain and blistering. The subject design of the foot portion of the tights address these deficiencies and greatly improve the dancers' experience.

The personal needs, aesthetics and performance deficiencies for rehearsal (uniforms) and performance (costumes) tights gives rise to the need for an evolution in the design and manufacture of tights that addresses these failings and is responsive to the unmet demands of female dancers and other female athletes that use ballet/dance tights while training, practicing or performing.

Embodiments of the subject tights, which can be referred to as CORSU Tights, can address one or more, and preferably all, of the aforementioned deficiencies. Such deficiencies or needs can be addressed by the subject tights incorporating one or more or all of the following: yarn that is soft, flexible, and durable; weaves that are soft, flexible and durable that allow for a greater range of motion; flat seams that are notably more comfortable and thoughtfully positioned; a built-in panty that is designed for the female anatomy and physiology, which sufficiently covers the dancer's genitalia, and which incorporates a gusset that is not outwardly seen by the public and provides moisture absorption and wicking protection and is comfortable, offers a greater range of motion and provides greater peace of mind for the dancer; a comfortable and supportive waistband; and a foot portion that provides additional utility, increased traction, improved comfort, support and safety; and careful consideration to colors and opacity levels to enhance vibrancy and increase uniformity of dancers varying skin tones under stage lights.

Embodiments of the subject tights can utilize a specially constructed yarn (FIG. 1) that is soft to the touch for reduced irritation, increased durability, and flexibility of movement and extension. The yarn can be used to provide tights with enhanced softness, longer durability, and greater flexibility (freedom of movement). A specific embodiment of yarn (FIG. 1) that can be utilized in the subject tights incorporate a Spandex core with a denier of 20 covered by Nylon of 34 filaments and a denier of 40 (i.e., 20/40/34) A denier as used herein is a term of art that historically referred to a unit of measurement that equals one gram of mass per 9000 meters of length, and is now commonly used to denote the thickness of yarn or thread. Spandex is a long-chain synthetic polymeric fiber (polyurethane). Soft and rubbery segments of polyester or polyether polyols allow the spandex fiber to stretch up to 600% and then recover to its original shape. Hard segments of the spandex fiber, usually urethanes or urethane-ureas, provide rigidity and so impart tensile strength and limit plastic flow. The spandex core, together with the nylon wrappings around the spandex core, is then used to create a weave to form the rights fabric (or weave). Embodiments of the yarn used to create the tights weave can have a range of 10-15% spandex and 85-90% nylon; 13-14% spandex and 86-87% nylon; and/or 13.7% spandex and 86.3% nylon (e.g. 20/40/34 weave). In various embodiments, the denier of the spandex can be in the range 19-21, 18-22, 15-25; and the denier of the nylon can be in the range 35-45, 39-41; and/or 40; and the nylon can incorporate 30-40, 32-36, and/or 34 filaments.

A production technique for making garments using Spandex yarn is knitting bare or covered Spandex yarn within the garment. This is the vanisé or plated technique, where one yarn appears on the front and the other on the back of the back of the fabric. It is generally used in alternate rows of knit yarn. Finally, the covered yarn can be used in every row, i.e., in every thread of the knit, for three dimensional stretch. Covered Spandex is also used. The covering involves wrapping the Spandex in the main yarn in the Nylon hosiery, so that the Spandex becomes the yarn core.

Four processes can be used for covering the Spandex:

1) Single covered: the nylon or other fiber is wrapped in a spiral around the Spandex once only with an average of 1,200-2,200 turns/meter. The more turns, the higher the quality.
2) Double covered: the Spandex yarn is wrapped in two layers of Nylon or other fabric, one clockwise and the other anticlockwise. The average number of turns is 2,400 turns/meter, but this number can reach 3,000 per meter in ultra-high quality yarns. It is used in yarn intended for the production of high quality sheer tights.
3) Air covered: Spandex in tension and texturized Nylon are passed together through a jet of air, interlacing the nylon at intervals to Spandex core.
4) Core-spun: during the yarning process the Spandex is covered with a coating of discontinuous fibers.

Figure 2A:
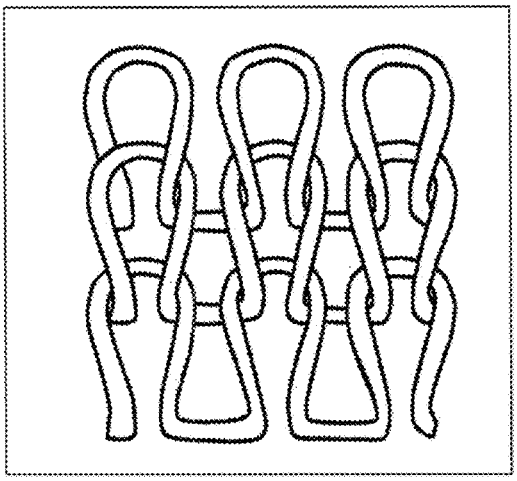
FIG. 2A shows an embodiment of a Weff Jersey knit (circular continuous weave) weave used in the tights material that can be incorporated with a garment in accordance with embodiments of the subject invention.
Figure 2B:
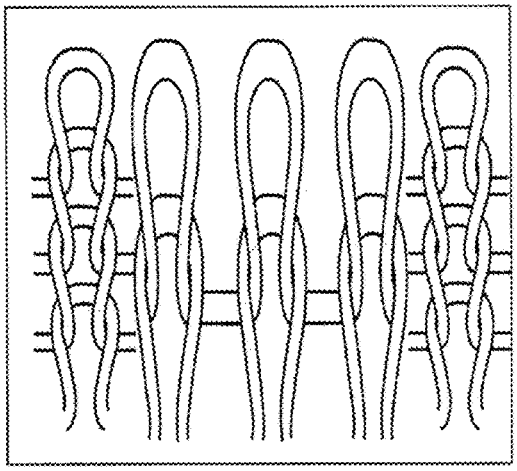
FIG. 2B shows an embodiment of a 1×3 Rib knit weave used in the waistband that can be incorporated with a garment in accordance with embodiments of the subject invention.
Figure 2C:
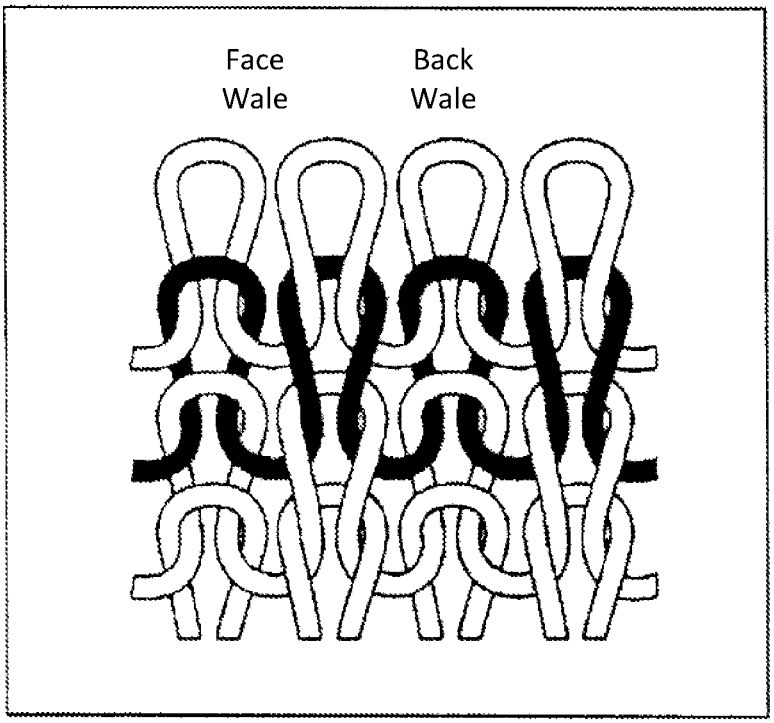
FIG. 2C shows an embodiment of a weave used in the tights reinforcement region that is seamed to the waistband can be incorporated with a garment in accordance with embodiments of the subject invention.
Figure 2D:
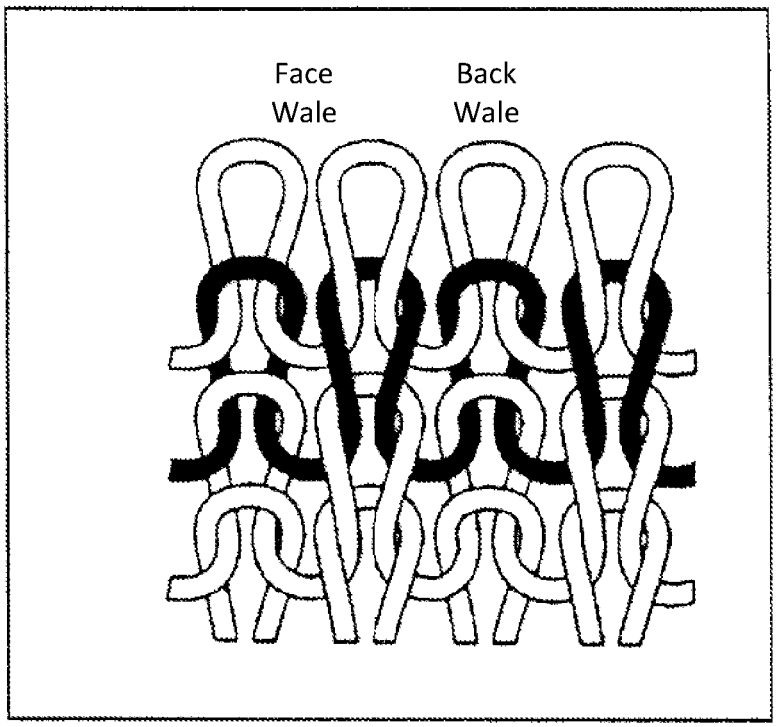
FIG. 2D shows embodiment of a weave used in the toe reinforcement region that can be incorporated with a garment in accordance with embodiments of the subject invention.
Figure 3A:
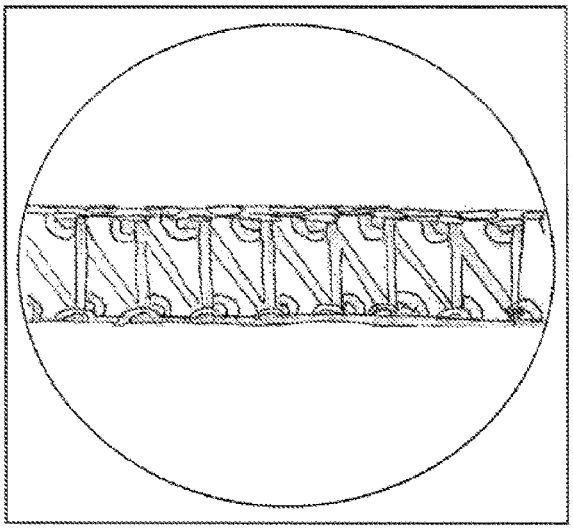
FIG. 3A shows an embodiment of a flat seam that can be incorporated with a garment in accordance with embodiments of the subject invention.
Figure 3B:
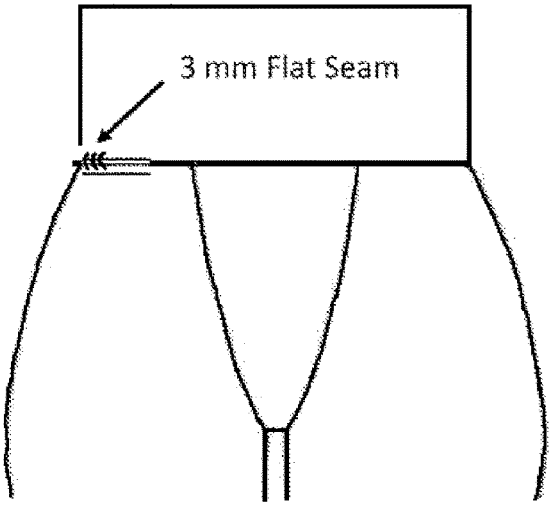
FIG. 3B shows a front view of a G-String (and Cheeky) embodiment incorporating a flat seam that can be used in the subject invention between the waistband and the tights.
Figure 3C:
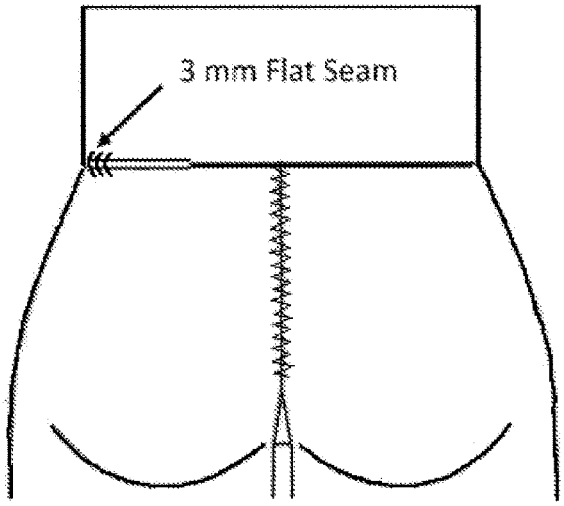
FIG. 3C shows a back view of a G-String embodiment incorporating a flat seam that can be used in the subject invention between the waistband and the tights.
Figure 3D:
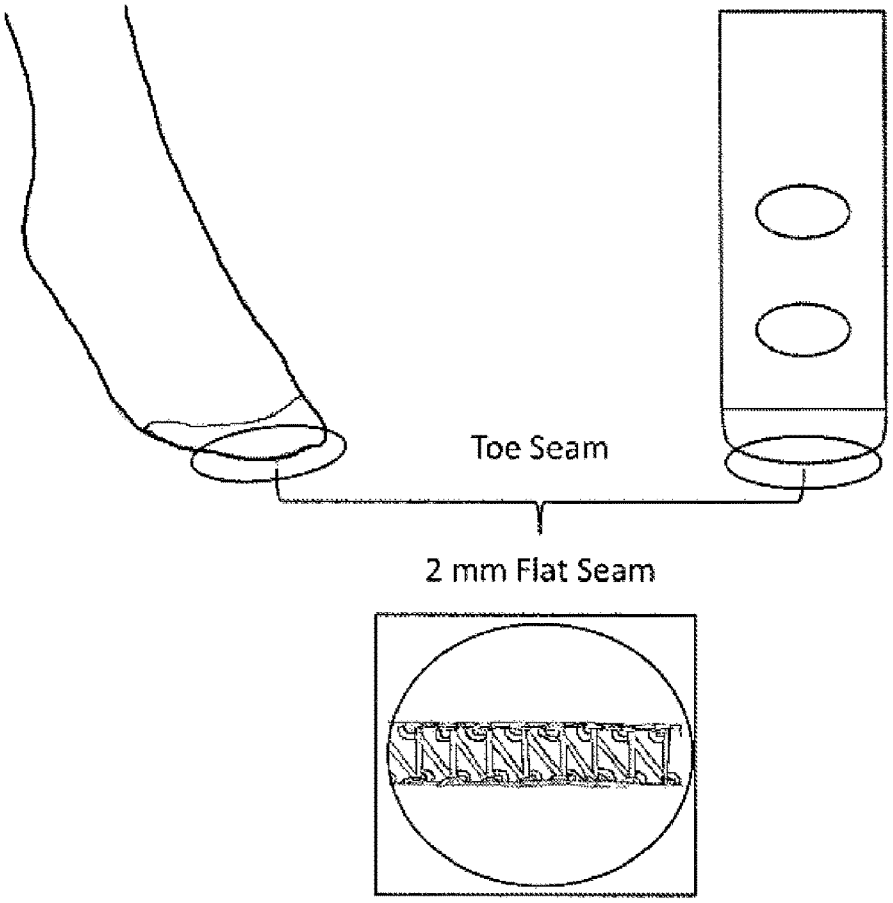
FIG. 3D shows an embodiment incorporating a flat seam in the toc area that can be used in the subject invention in the toe area of the tights.
Figure 3E:
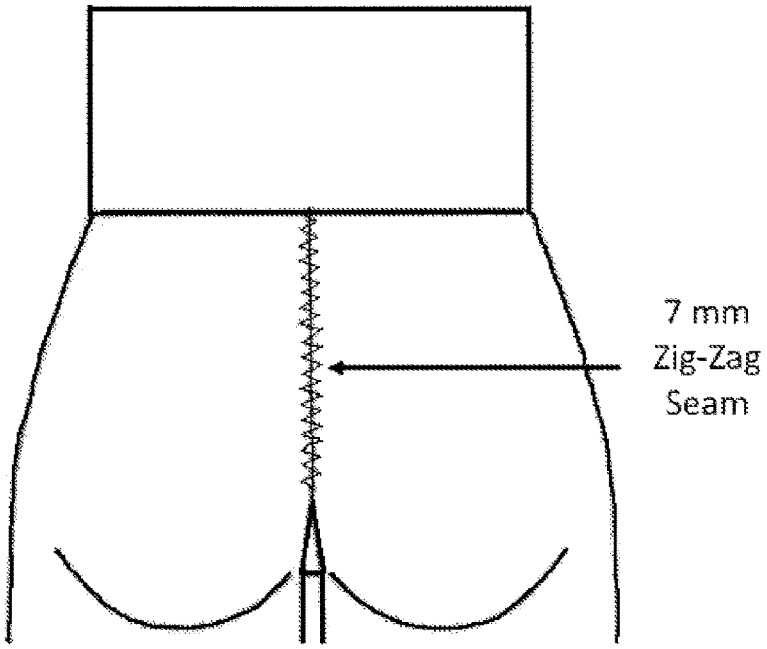
FIG. 3E shows a back view of an embodiment of a zig-zag seam that can be used in the subject invention to create the G-String effect of Option 1 30

Embodiments of the subject tights can utilize extra soft yarn (FIG. 1) to create especially designed weaves such as a Weft Jersey Knit (or Circular Continuous Weave) (FIG. 2A) for use in the tights material, 1×3 Rib Knit (FIG. 2B) for use in the Waistband, a first reinforced weave (FIG. 2C) to offer the dancer a compression-like effect, increased tights stretchability in parts of the tights, such as the portion of the tights seamed to the waistband, without compromising the elasticity and comfort and a second reinforced weave (FIG. 2D) for use in the toe area of the foot. Additional embodiments of the waistband can incorporate a 1×1, 1×2, or 1×4 Rib Knit. The weave used for the waistband does not stretch as much as the tight's weave for the same applied force.

Current tights in the market do not provide the comfort and health benefits of tights positioning the seams in accordance with embodiments of the subject tights, such that the seams do not cut into the private parts of the female dancer. The center seams in current tights lead to genital pressure that can result in Pudendal Neuralgia, defined as pressure on the pudendal nerve in the genital area. Additionally, the location of seams of current tights do not address the need for modesty during movement.

Embodiments of the subject tights can position seams to allow maximum comfort, aesthetics, support and flexibility in the attachment of the waistband to the tights, in the attachment of the panty assembly to the tights, in the attachment of the protection layers to the panty and each other, in the attachment of the panty to the G-string or Cheeky back panels, in the toe seam or in the openings in the bottom and the heel of the foot or in any other part of the tights.

Embodiments of the subject tights can utilize an extra soft yarn described as a nylon/spandex microfiber 20/40/34 (FIG. 1) that can be used to sew each individual seam (FIGS. 3A through 3D).

Embodiments of the subject tights can incorporate seams that are thinner than the seams of traditional tights, and include a flat seam fabricated with a industrial sewing machine (FIGS. 3A through 3D). Such a seam can be incorporated with parts of the tights, such as, but not limited to, the waist, crotch, underfoot, and over the toe. In addition, the G-string seam, using a zig-zag stitching over a small curled portion of the tights fabric, provides an uplifting effect of the buttocks area ultimately further increasing the aesthetics of the garment. The G-String seams can also incorporate a fillet (flat) seam with elastic, and can have a fillet seam with elastic, and a zig-zag seam on top of the fillet seam such that the filled (flat) seam adheres the elastic to the tights fabric and then on the outside of the fabric, when it is stretched, a zig-zag is sewn so that when the garment comes back at rest, it has a gathered effect. This construction produces a butt-lifting effect.

With respect to the panty and crotch region of the garment, current tights offer a football-shaped section where the legs of the tights are sewn together using a protruding and uncomfortable seam. The current crotch area of traditional tights is not designed to conform with the female anatomy which causes discomfort in many ways, is too small to adequately cover female genitalia for modesty purposes and is often made of the same non-wicking material as the rest of the tights garment.

Figure 4A:
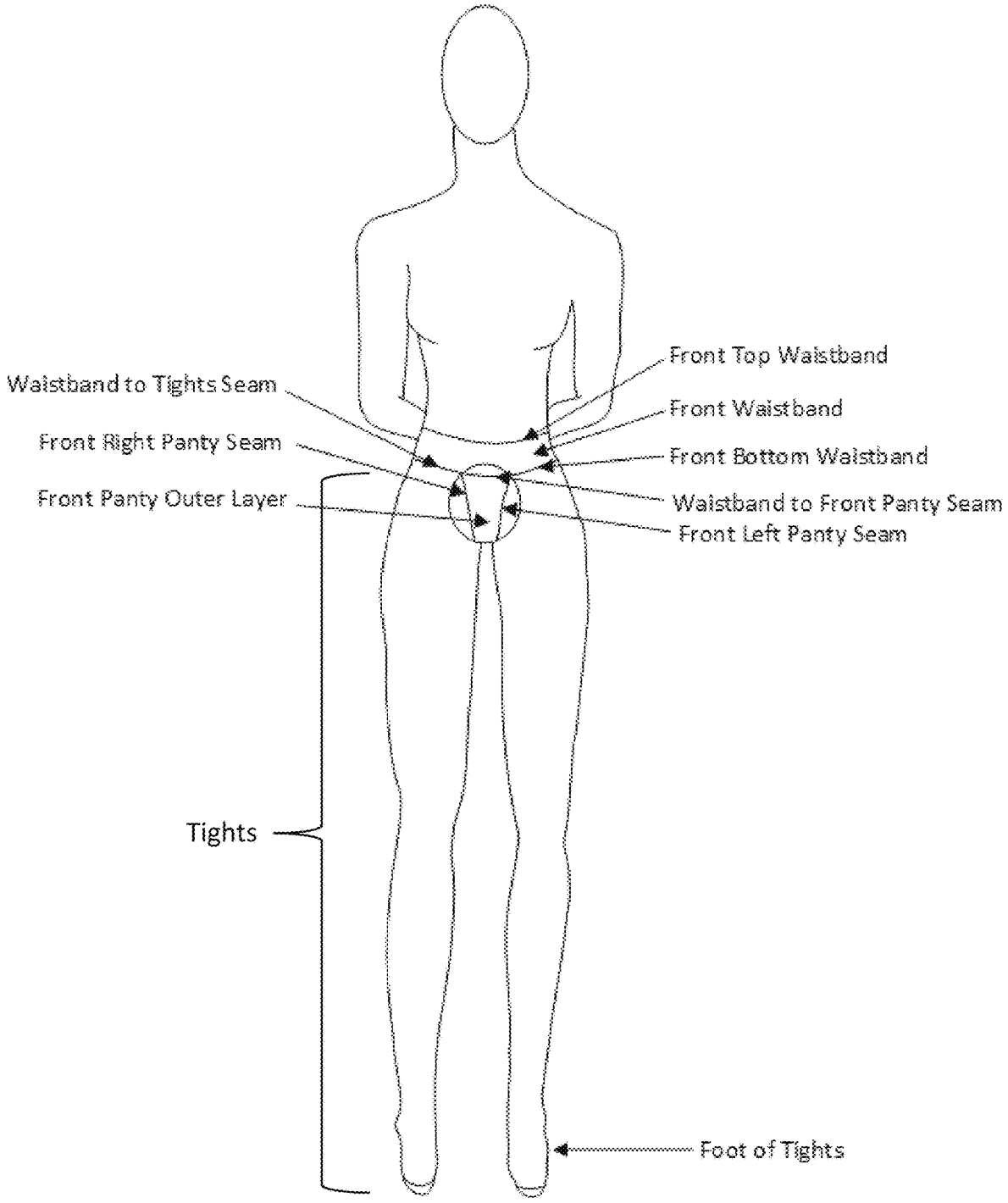
FIG. 4A shows a front outer view of a garment in accordance with embodiments of the subject invention.
Figure 4B:
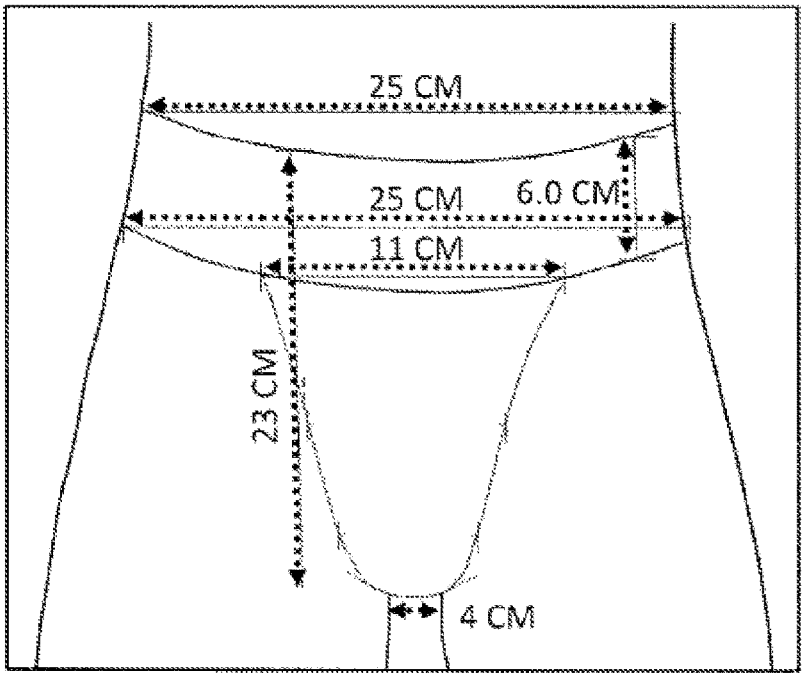
FIG. 4B shows a front outer view of the waistband and panty area, with measurements of the garment when unworn (medium size) in accordance with embodiments of the subject invention.
Figure 4C:
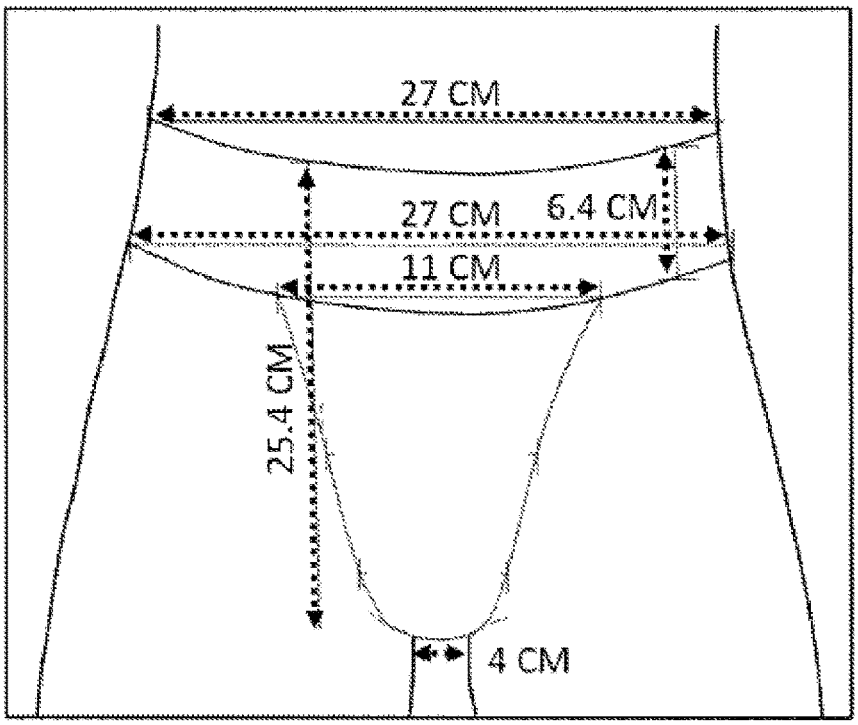
FIG. 4C shows a front outer view of the waistband and panty area, with measurements of the garment when worn (medium size) in accordance with embodiments of the subject invention.
Figure 4D:
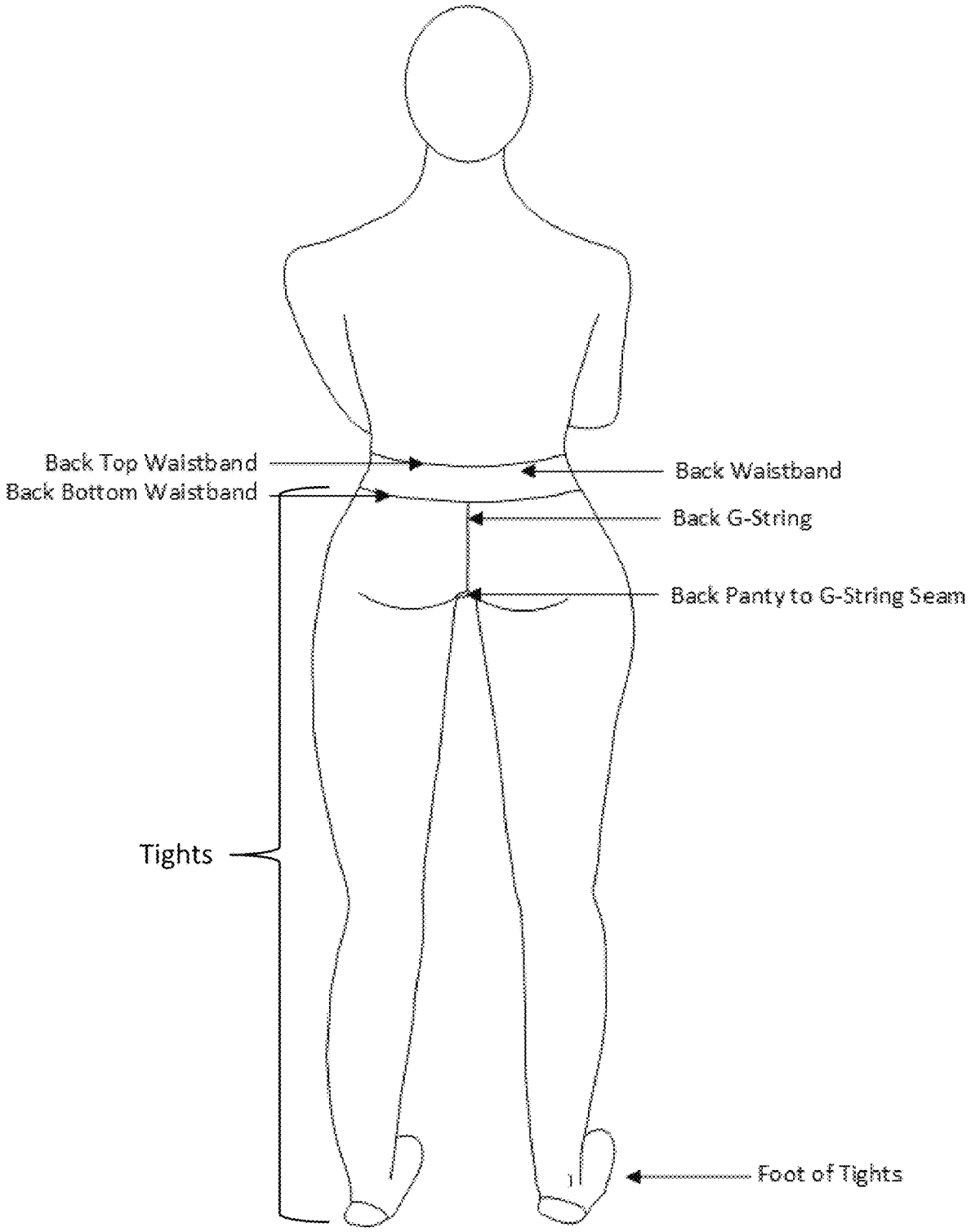
FIG. 4D shows a rear outer view of the G-String (Option 1) of a garment in accordance with embodiments of the subject invention.
Figure 4E:
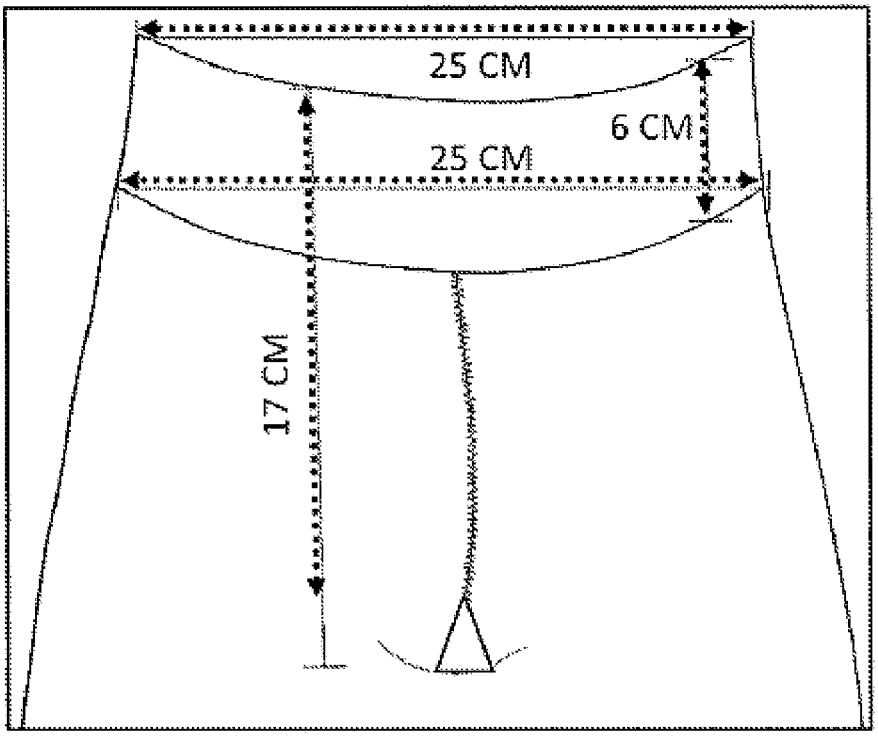
FIG. 4E shows a rear outer view of the G-String (Option 1) with measurements of the garment when worn in accordance with embodiments of the subject invention.
Figure 4F:
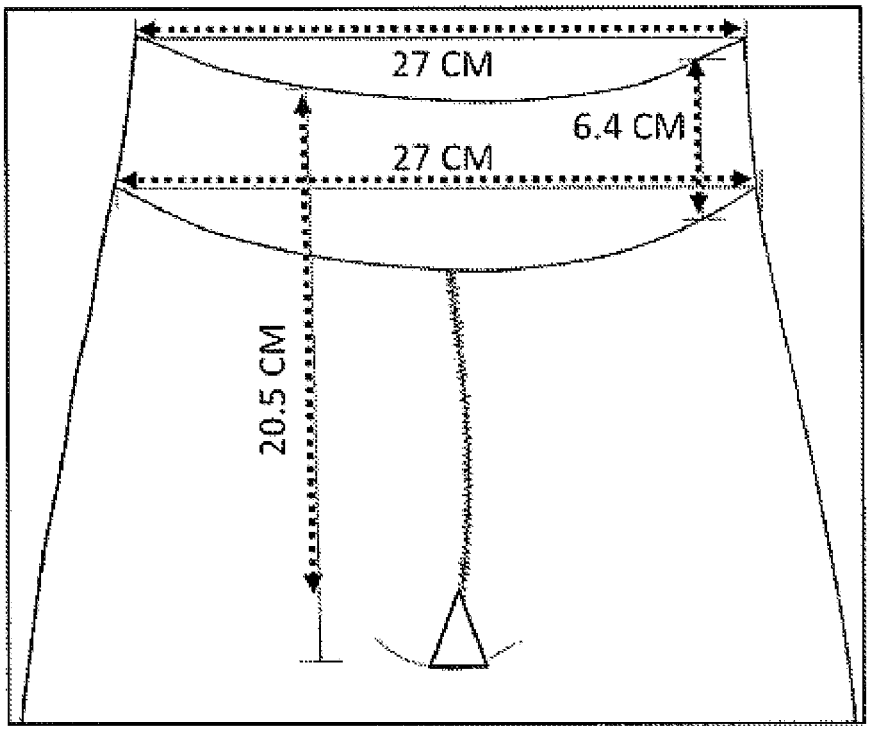
FIG. 4F shows a rear outer view of the G-String (Option 1) with unworn measurements of a garment in accordance with embodiments of the subject invention.

Embodiments of the subject tights can incorporate a V-shaped panty configuration with seams at the sides (instead of the center) (FIGS. 4A, 7A and 7B) that will provide sufficient coverage to alleviate the need for the dancer to don additional layers of apparel (trunks) for modesty during rehearsal or performance. The V-shaped panty configuration and seams down the sides instead of in the center eliminate unwanted body-contour visual effects when wearing the tights. Various size embodiments from child to extra-large adults can/will be created.

The average size of a woman's vagina ranges from 6.8 cm to 15 cm (2.7" to 5.9") in length and 3 cm to 6 cm 1.9" to 2.5" in width. Typical dimensions of the crotch area of common tights on market are 6.35 cm (2.5") in length and 3.17 cm in (1.25") width. This creates a shortfall in coverage of 0.635 cm to 8.6 cm (0.2" to 3.4") in length and 0.88 cm to 3.18 cm (0.88" to 3.18") in width when compared to the average size of female genitalia.

Embodiments of the subject tights can incorporate a crotch size with large enough dimensions to fit most women while providing comfort and modesty. In an embodiment, the crotch dimensions can be 10 cm to 14 cm (e.g., 5") in width at the widest point and 15 cm to 23 cm in length. As the "V" shape narrows, the width decreases at the rate of approximately 2 cm to 2.5 cm for every 2.5 cm of length (¾"-1" for every 1" of length). This design and the incorporated dimensions can result in complete coverage for most, if not all, women.

Current tights in the market include one very thin layer of fabric/weave in the inner crotch or gusset region of the garment, which is often the same fabric/weave that is utilized for the entire tights garment, giving no consideration to moisture control, hygiene or leak prevention.

Medical information regarding moisture and vaginal discharge is provided below:

Dr. Rankin, a noted gynecologist, states that the average amount of discharge a woman of reproductive age secretes over a period of eight hours weighs 1.55 grams (a gram is equivalent to about ¼ teaspoon). Additional observations by Dr. Rankin include:

a) A woman produces the greatest amount of discharge (1.96 grams) around the time of ovulation.

b) Some women have ectropion, when the mucous-producing glands that are usually on the inside of the cervix evert onto the outside of the cervix. If a woman's cervix has this normal feature, she may produce more cervical mucous, which increases the amount of vaginal discharge she has.

c) Teenage girls may have a large amount of a watery discharge caused by high hormone levels during the teen years or by taking birth control pills.

d) The discharge may or may not have a pigment.

(1) Discharge with Infection a) Bacteria require a certain amount of moisture to grow. Botulism bacteria are organisms that thrive in moisture and form spores. This means that when conditions are dry, the bacteria may lie dormant. When moisture returns, however, the spores activate, resulting in bacterial growth. According to Merck Manuals Online Medical Library, the reproduction of this bacteria is highly toxic and in severe cases, lethal.

b) The discharge may or may not have a greenish pigment to it.

(2) Moisture a) One of the most common causes of a rash is genital skin irritation that may occur when tight-fitting or wet clothes rub against the skin. A sore, blister, or lump in the vaginal area may occur from such skin irritation, resulting in the need for medical attention.

Embodiments of the subject tight incorporate a generally V-shaped panty configuration that can include two or three layers of absorption and wicking fabric (cotton-mix and poliuretano, or polyurethane) as part of the gusset (FIG. 6A), These layers are designed to wick and trap the unwanted moisture caused by secretion or discharge from normal bodily functions. These features can greatly diminish the risk of infections. These are important and integral improvements, since otherwise dancers sacrifice their comfort, aesthetics, hygiene, and basic dignity, thus changing the quality of performance of a dancer.

Figure 6A:
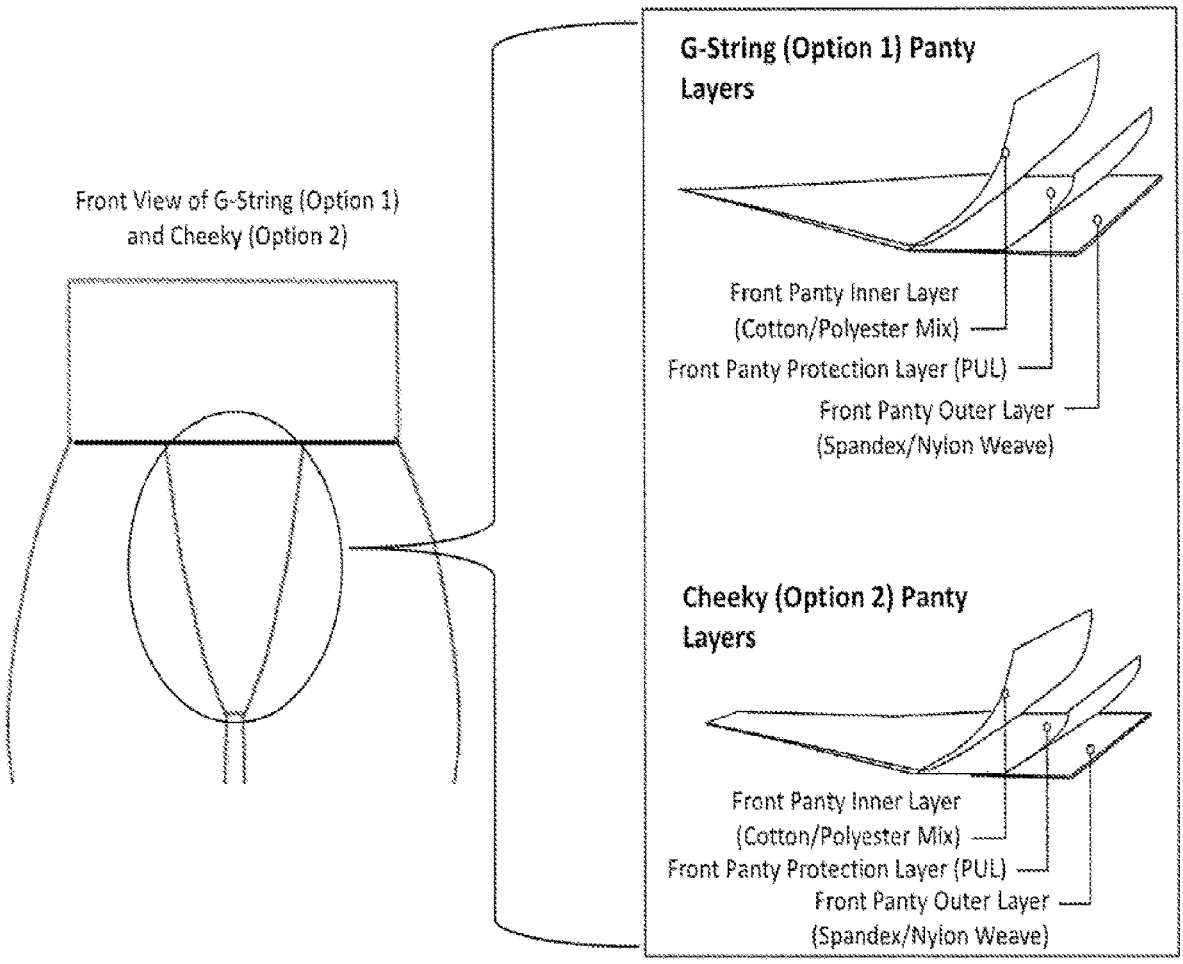
FIG. 6A shows a front view of the panty assembly and inner layers in the crotch area of both the G-String (Option 1) and the Cheeky (Option 2) versions of a garment in accordance with embodiments of the subject invention.

FIG. 6A shows Layer 1, which is closest to the body, made of a cotton fabric composed of 50% polyester and 50% cotton, functioning to absorb and isolate moisture. Other materials can be used for this first layer, such as cotton/polyester mix of various proportions of cotton (e.g., 20% to 100% cotton and 0% to 80% polyester), Jersey, cotton/nylon mixes, and wool.

FIG. 6A also shows Layer 2, between Layer 1 (the cotton/polyester mix) and the outer garment, where layer 2 can be made of PUL fabric composed of 73% polyester and 27% poliuretano (polyurethane), and functions to prevent leaks and make the garment impermeable to moisture. Other materials can be used for this second layer as well to block moisture from traveling from layer 1 to the outer tights fabric layer 3. An embodiment of a PUL (polyurethane laminate) is a compound fabric that can be made by laminating a cloth fabric to one or both sides of a thin film of polyurethane. There are two processes used for lamination: solvent lamination, which fuses the fabric and polyurethane film into a single monolithic fabric, and hot melt, which uses heat-activated glue to adhere the fabrics together. Other techniques for making a PUL can also be used.

FIG. 6A also shows layer 3, which can be the same material as the tights fabric, or can be another material as desired.

The positioning of the inner waterproof layer is illustrated in FIG. 6 where it is positioned between an outer layer (layer 3) and an inner absorption layer (layer 1), and held in position by the seams on the right and left which attach all three layers at the edges. In a specific embodiment, layer 3 can be a separate piece of tights fabric seamed to the tights fabric adjacent to the panty panel. In an alternative embodiment, layer 3 can be configured with the tights fabric adjacent to the panty panel and layers 1 and 2 can be seamed to layer 3 to form the panty panel.

Figure 6B:
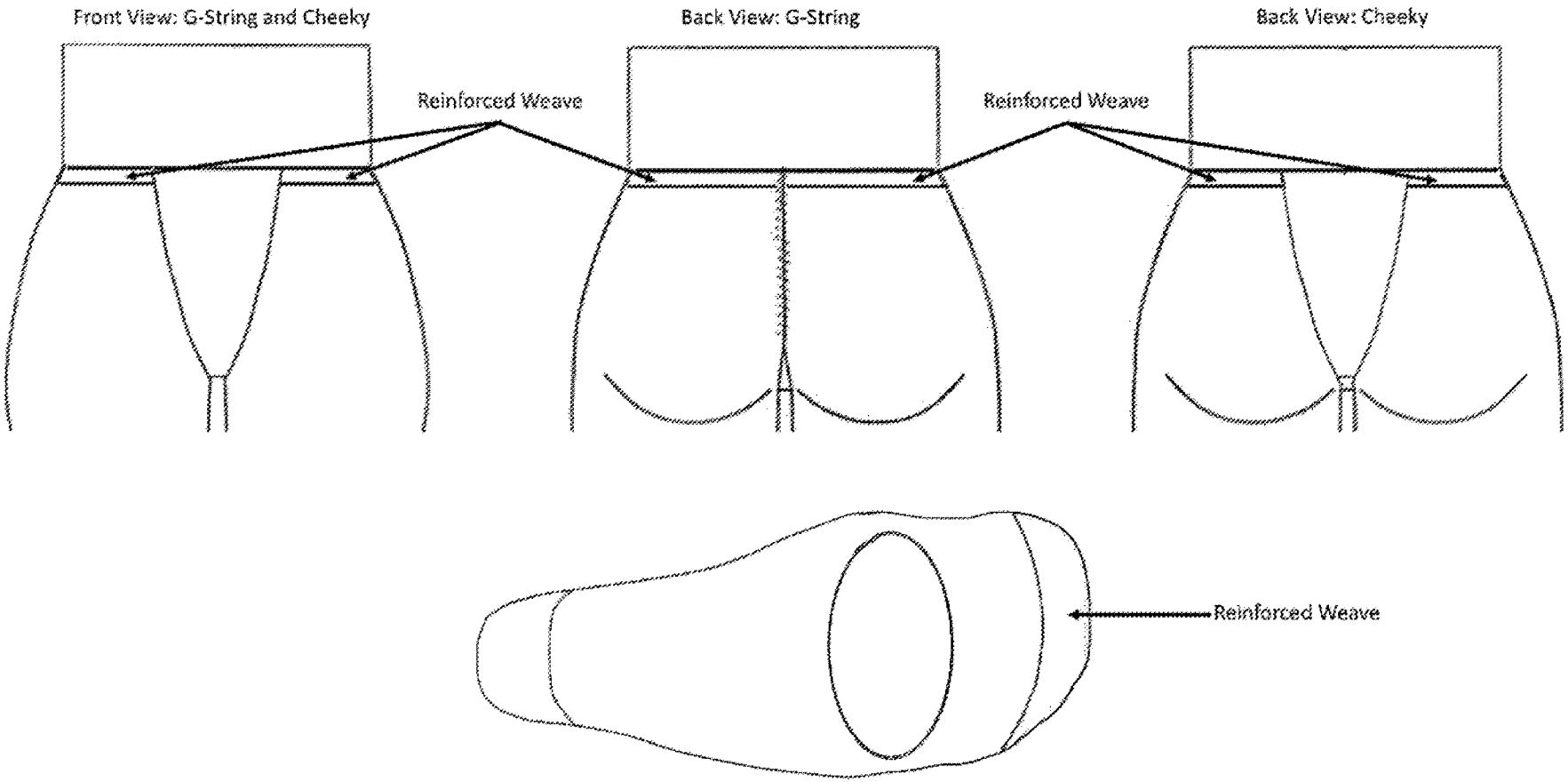
FIG. 6B shows views of the reinforcement areas of a garment incorporating a reinforcement weave in accordance with embodiments of the subject invention.

FIG. 6B shows a waist reinforcement weave located adjacent the waistband that stretches more than the tights weave for the same applied force, and by stretching when the dancer stretches reduces the force applied to the adjacent tights weave. The waist reinforcement weave can be seamed to the waistband and transition to the tights weave via weave transition.

FIG. 6B also shows a toe reinforcement weave located at the distal end of the foot portion that does not stretch as much as the tights weave for the same applied force, and provides protection for the tips of the toe. The toe reinforcement weave can transist to the tights weave via weave transition, and the distal end of the foot portion can be scanned closed by securing the toe reinforcement weave to itself with a flat weave (e.g., a 2 mm flat seam).

Referring to FIG. 6B, the tights can be referred to as portions for ease of describing where seams, change in materials, different weaves, cut-outs, and reinforcing weaves are positions, a lower torso portion, a waistband portion, and a panty (or crotch) portion, such that the distal ends of the two leg portions transition into the foot portions, the proximal ends of the two leg portions transition to the lower torso position and connect to the panty position, while the lower torso position connects to the waistband via a seam and connects to the panty portion via two seams. The torso position can connect to the cheeky back of the panty portion via two seams (see FIG. 6B) or connect with itself via a G-string seam (e.g., zig-zag seam). The waistband portion can connect to the lower torso portion, front panty portion, and back cheeky panty portion (if cheeky option) via seams, and the panty portion can connect to lower torso portion and waistband via seams.

Figure 7A:
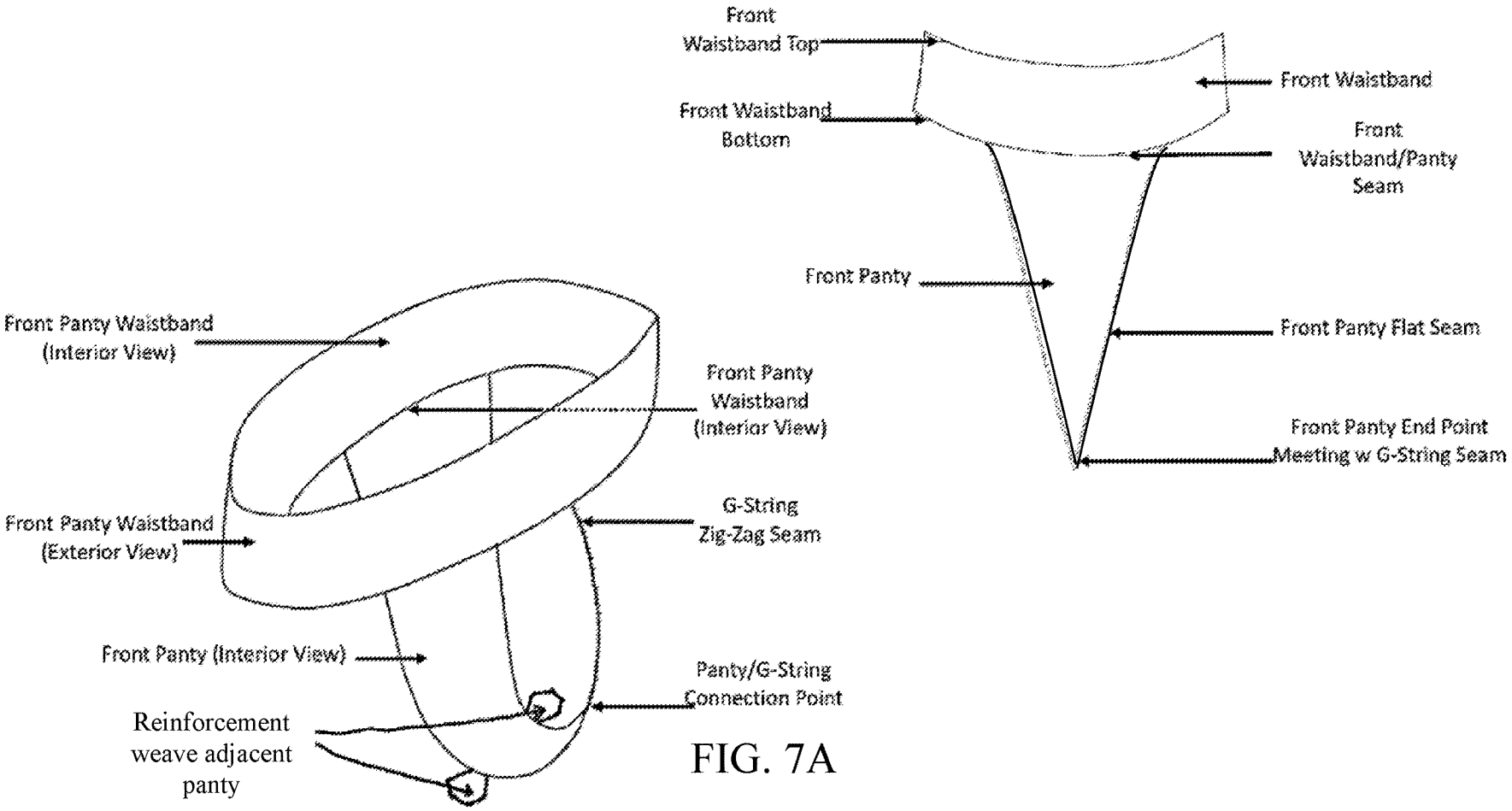
FIG. 7A shows 3-dimensional views of the panty, waistband, and G-String (Option 1) assembly of a garment incorporating a reinforcement weave adjacent the panty, in accordance with the embodiments of the subject invention.
Figure 7B:
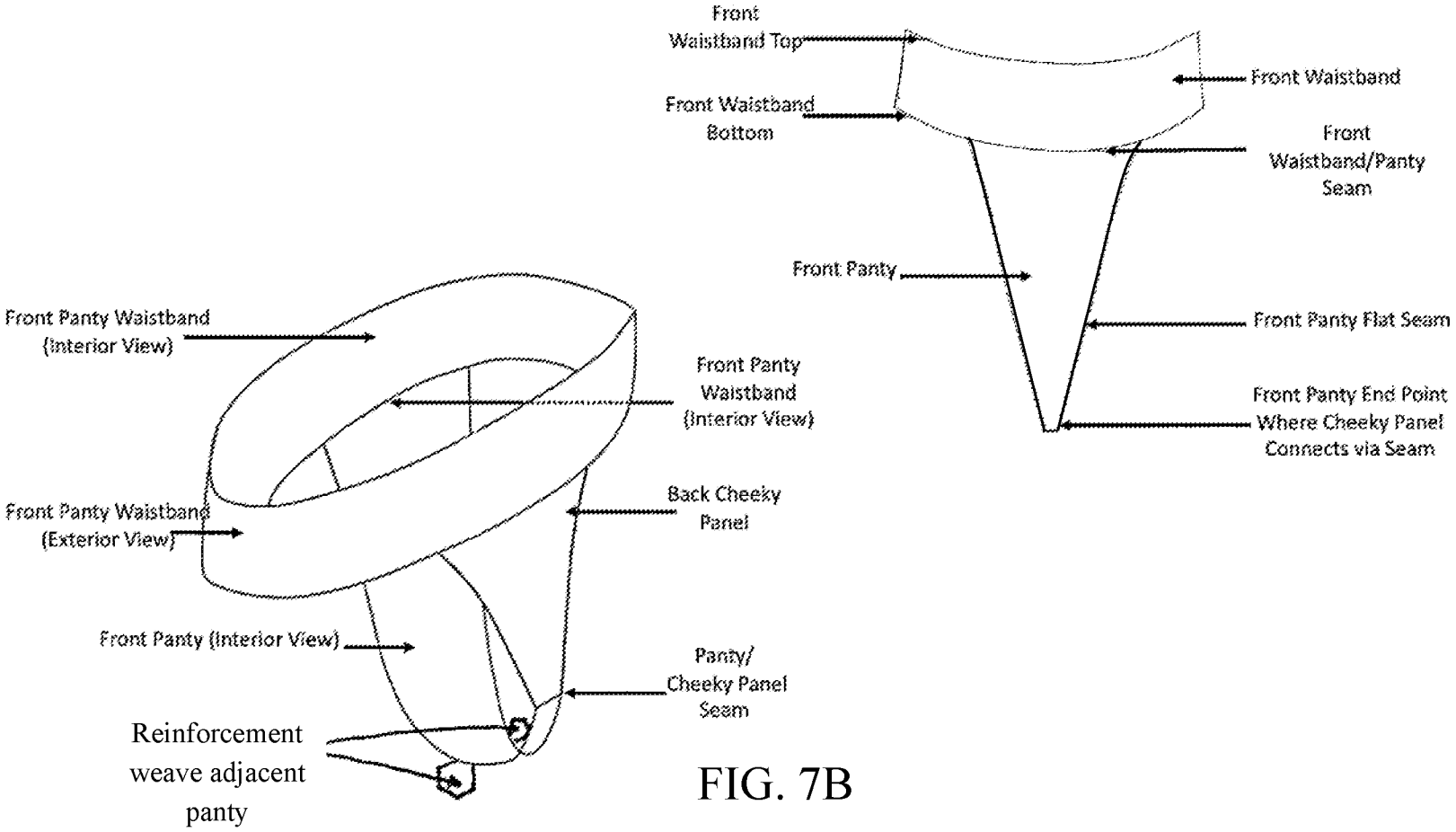
FIG. 7B shows 2-dimensional and 3-dimensional views of the panty, waistband, and G-String (Option 1) assembly of a garment incorporating a reinforcement weave adjacent the panty, in accordance with the embodiments of the subject invention.
Figure 8:
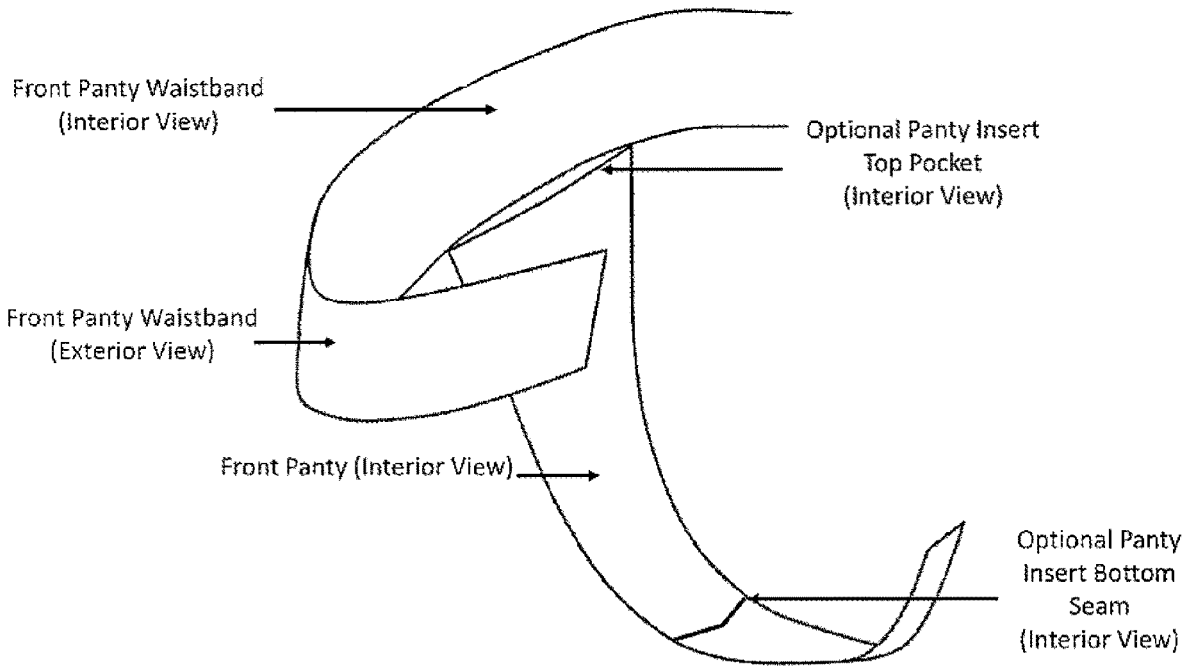
FIG. 8 shows a 3-dimensional interior view of the panty and waistband highlighting the optional protective insert pockets on the interior of the panty of a garment in accordance with the embodiments of the subject invention.

FIGS. 7A and 7B show a panty reinforcement weave located adjacent the panty panel that stretches more than the tights weave for the same applied force, and by stretching when the dancer stretches reduces the force applied to the adjacent tights weave. The panty reinforcement weave can be seamed to the panty panel and transition to the tights weave via weave transition.

Figure 4G:
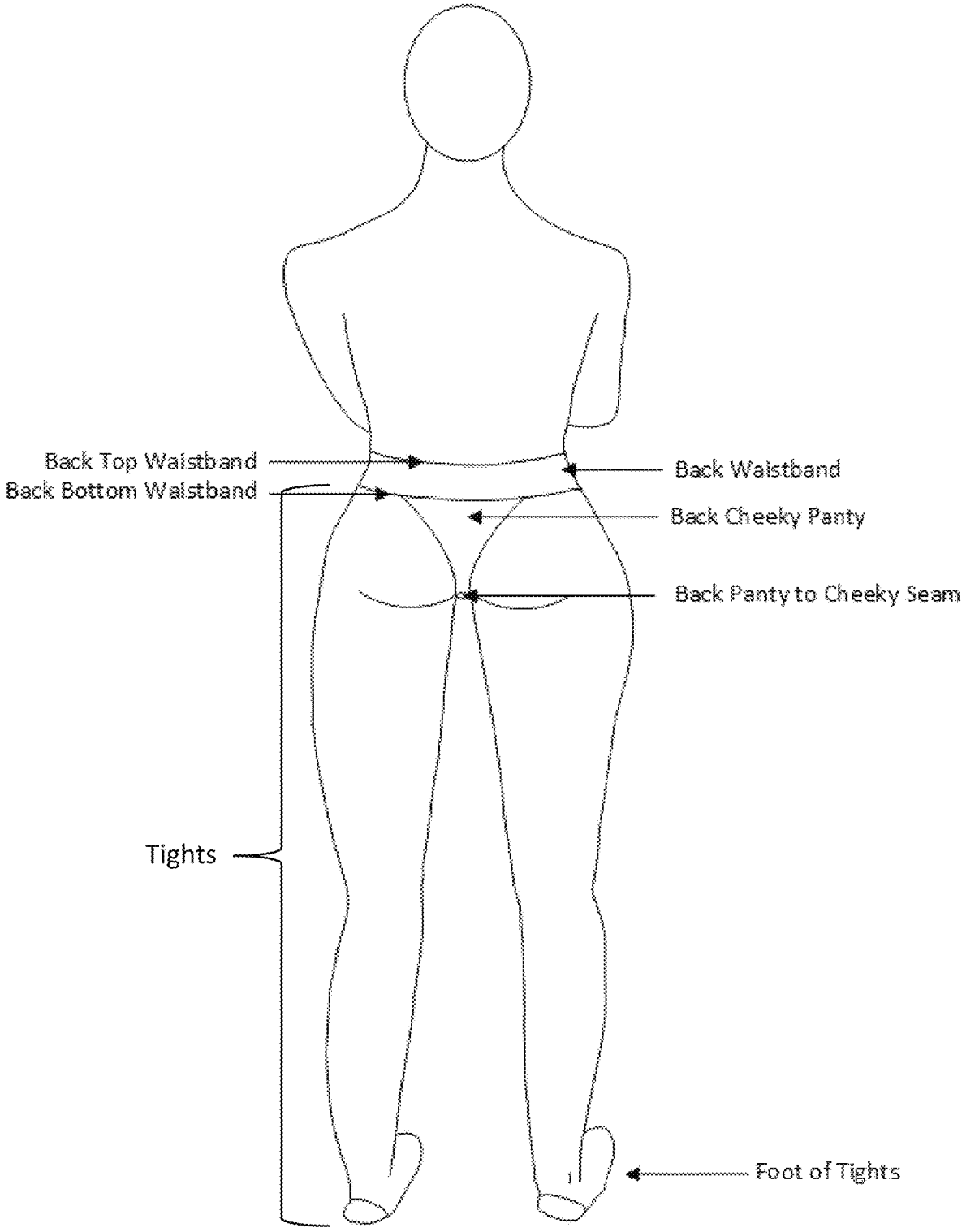
FIG. 4G shows a rear outer view of the Cheeky (Option 2) of a garment in accordance with embodiments of the subject invention.
Figure 4H:
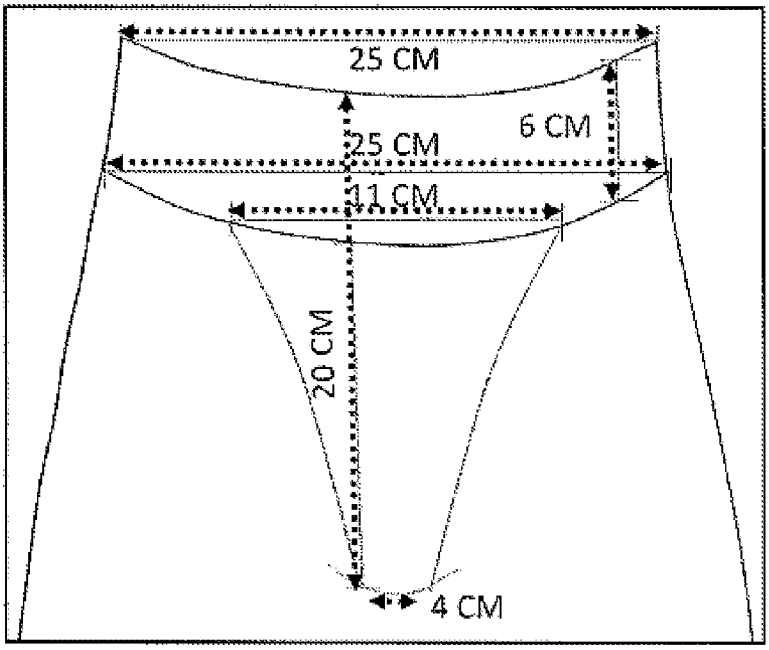
FIG. 4H shows a rear outer view of the Cheeky (Option 2) with measurements of the garment when unworn in accordance with embodiments of the subject invention.
Figure 4I:
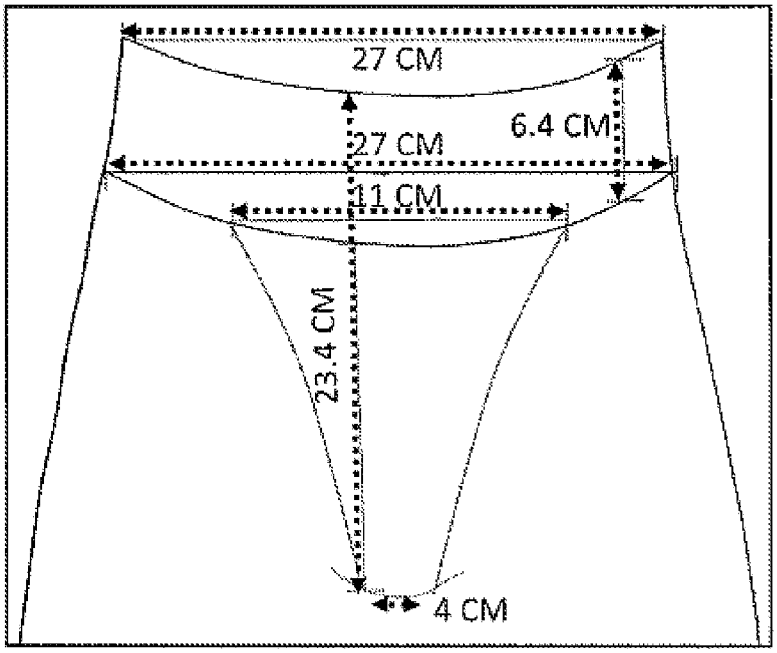
FIG. 4I shows a rear outer view of the Cheeky (Option 2) with measurements of the garment when worn in accordance with embodiments of the subject invention.
Figure 5A:
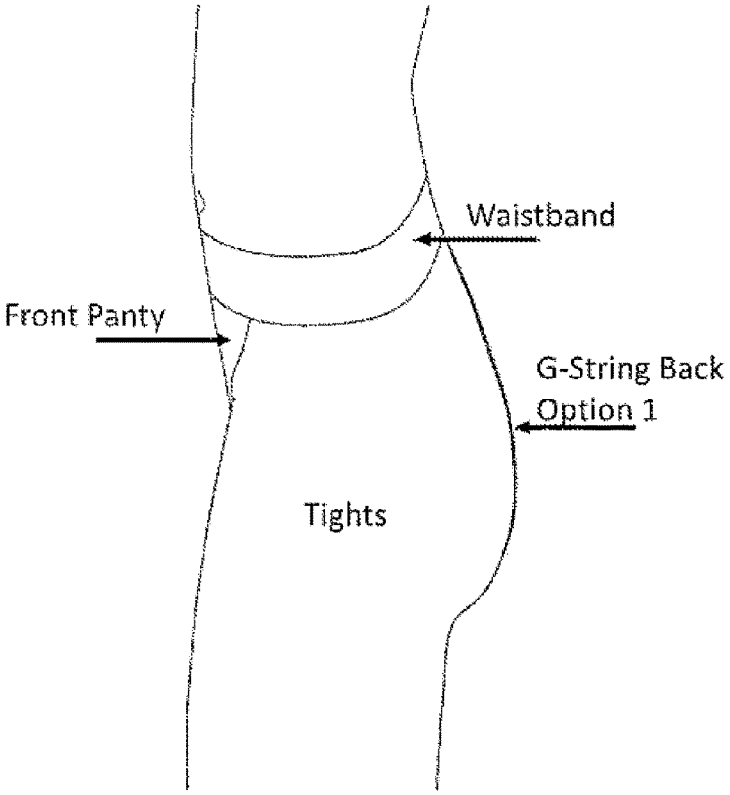
FIG. 5A shows the side outer view of the G-String (Option 1) of a garment in accordance with the embodiments of the subject invention.
Figure 5B:
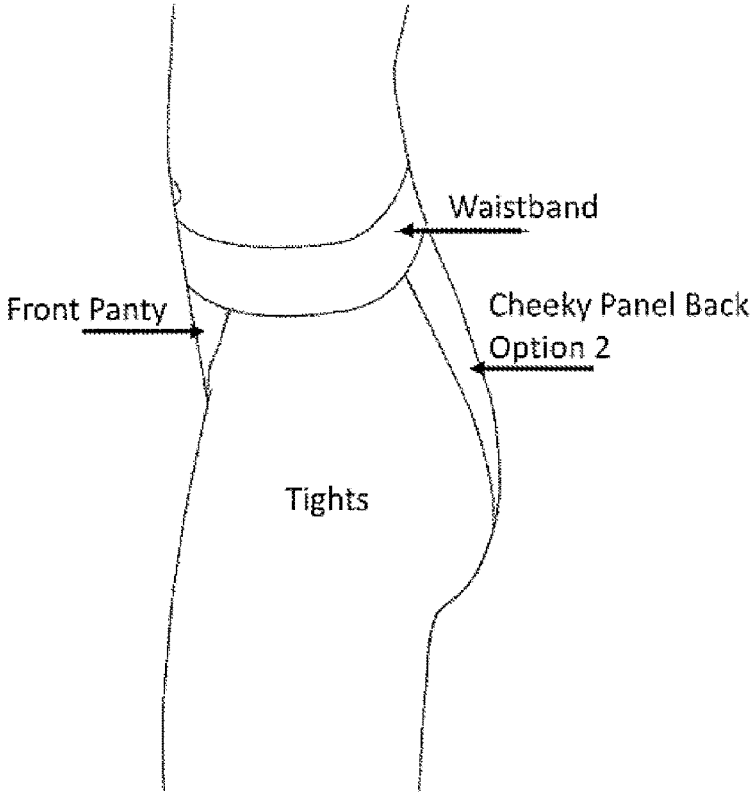
FIG. 5B shows the side outer view of the Cheeky (Option 2) of a garment in accordance with the embodiments of the subject invention.

Current female adolescent tights available in the market today reveal unsightly underwear lines as worn by children dancers. Embodiments of the subject tight can incorporate a rear panel that more closely resembles full back panties (FIGS. 4G, 5B and 7B). This embodiment of the tights, while available for adults, serves well as an alternative for female adolescents and can also satisfy common uniform/costume mandates.

Current tights available in the market typically include waistbands that do not adequately support and distribute the elongation of the waist line to provide the comfort needed for extended wear, due to thin elastic construction. This dynamic can lead to discomfort, pain, loss of circulation, inhibited breathing, uncomfortable imprint on the skin, producing effect of roll-over fat even on otherwise thin body types, producing the illusion and/or feel of a full bladder or bloating. Wider waistbands of the subject invention allow the intestines to move naturally with the dancer's movement, known scientifically as peristalsis. This natural movement is crucial to proper digestion and to reduce bloating. Most doctors recommend that people with acid reflux avoid tight clothing because it can make their condition worse. The more hours a dancer wears a tight waistband, the more bloated the dancer's intestines become, leading to a fatigued dancer.

Currently, dancers wearing typical tights often modify their tights (uniform/costume) by cutting slits in the waistband of the tights to relieve the pressure. Any desecration to the tights precludes the dancer from being able to return the tights to the manufacturer and leads to increased risk of rips and/or runs in the tights.

Embodiments of the subject tights remove a portion of, or all of, the elastic waistband, as compared to typical tights, to address the deficiencies noted above. The tights having the subject waistband reduce the pain and discomfort associated with the constricting waistband of typical tights, relieving the dancer of uncomfortable and embarrassing body distribution. The removal of a portion of, or all of, the elastic waistband, as compared to typical tights, allows the dancer to breathe normally, move freely, and eliminates the need to suck in the stomach to remove the appearance of skin rolls. The subject tights having such a waistband allow for dancers who suffer from acid reflux to freely move about without exacerbating their health issue. Removing the motivation to cut out portions of the waistband allows a longer usability time frame for dancer's tights and the ability to return the tights to the manufacturer if needed.

Figure 10A:
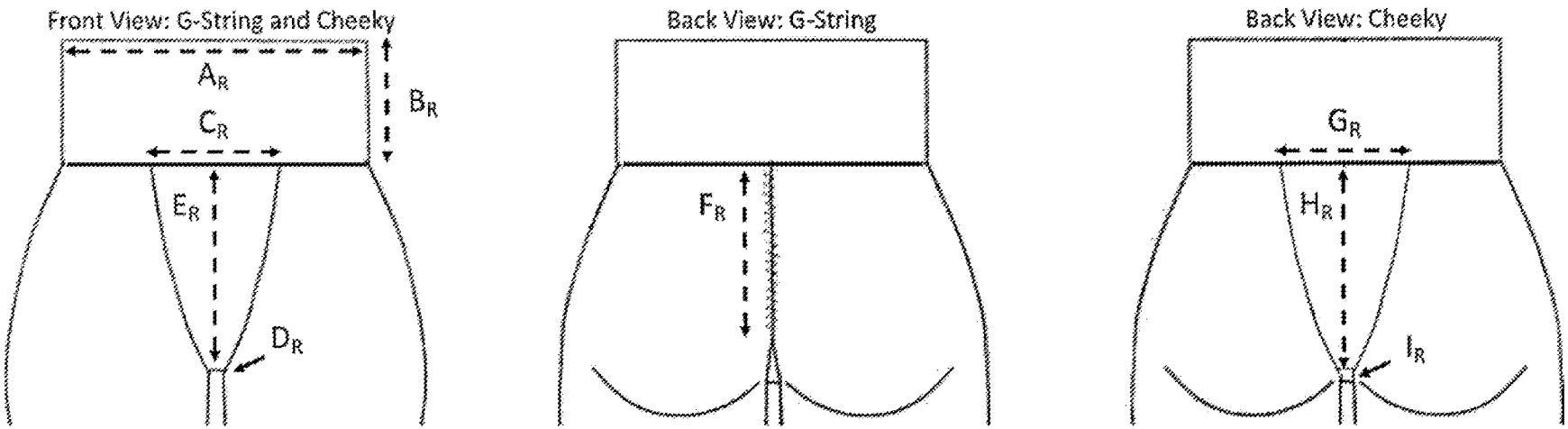
FIG. 10A shows a front outer view of the panty, a rear outer view of the G-String (Option 1), and a rear outer view of the Cheeky (Option 2), with at rest measurements of a garment in accordance with the embodiments of the subject invention.
Figure 10B:
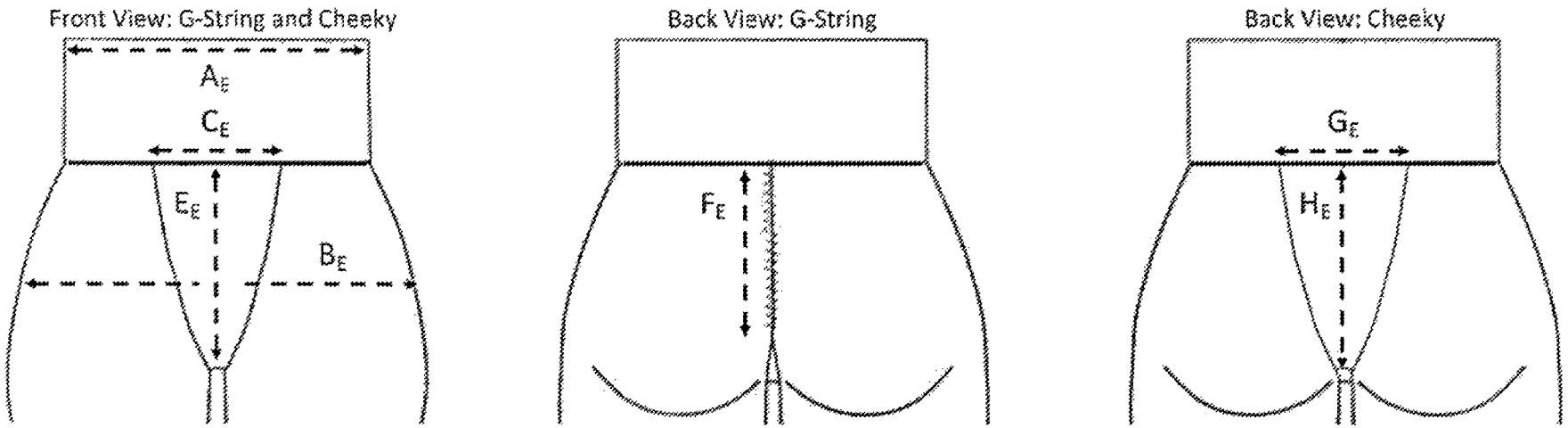
FIG. 10B shows a front outer view of the panty, a rear outer view of the G-String (Option 1) and a rear outer view of the Cheeky (Option 2), with elongated measurements derived from the manufacturer's machine-run stretchability testing of a garment in accordance with the embodiments of the subject invention.

Embodiments of the subject tights extend the height of the waistband by 1 cm to 12 cm on average with respect to typical tights for sufficient support (FIGS. 4A, 4B, 4C, 7A and 7B). This provides hold without restricting movement, breathing, and/or circulation. As shown in FIGS. 10A and 10B, the size of the stretch measurements for stretch tolerance of the waistband is 55 cm to 62 cm for a size extra small (XS) to extra large (XL), respectively, and can tolerate an additional stretch of 1 cm to 3 cm.

Currently available tights have only one cut-out at the bottom of the foot. There are no ballet tights in the market that have a cut-out in the heel area. The current tights cause a lack of grip from heel to the shoe causing the dancer to over pull the drawstring to tighten the pointe shoe. This leads to increased blistering and discomfort/pain. In order for a dancer's heel to not slip off the shoe, dancers, tighten the draw string of the shoe too tightly, causing blisters and pain. In addition, dancers use rosin to add traction inside the pointe shoe where, if it comes in contact with an open sore, it can lead to a severe infection needing immediate medical attention. Additionally, currently available tights include foot portions that are squared at the ends that bunch and incorporate heavy protruding seams both of which cause pain and blistering. The design of the foot portion of the subject tights addresses these deficiencies and greatly improve the dancers' experience.

Figure 9A:
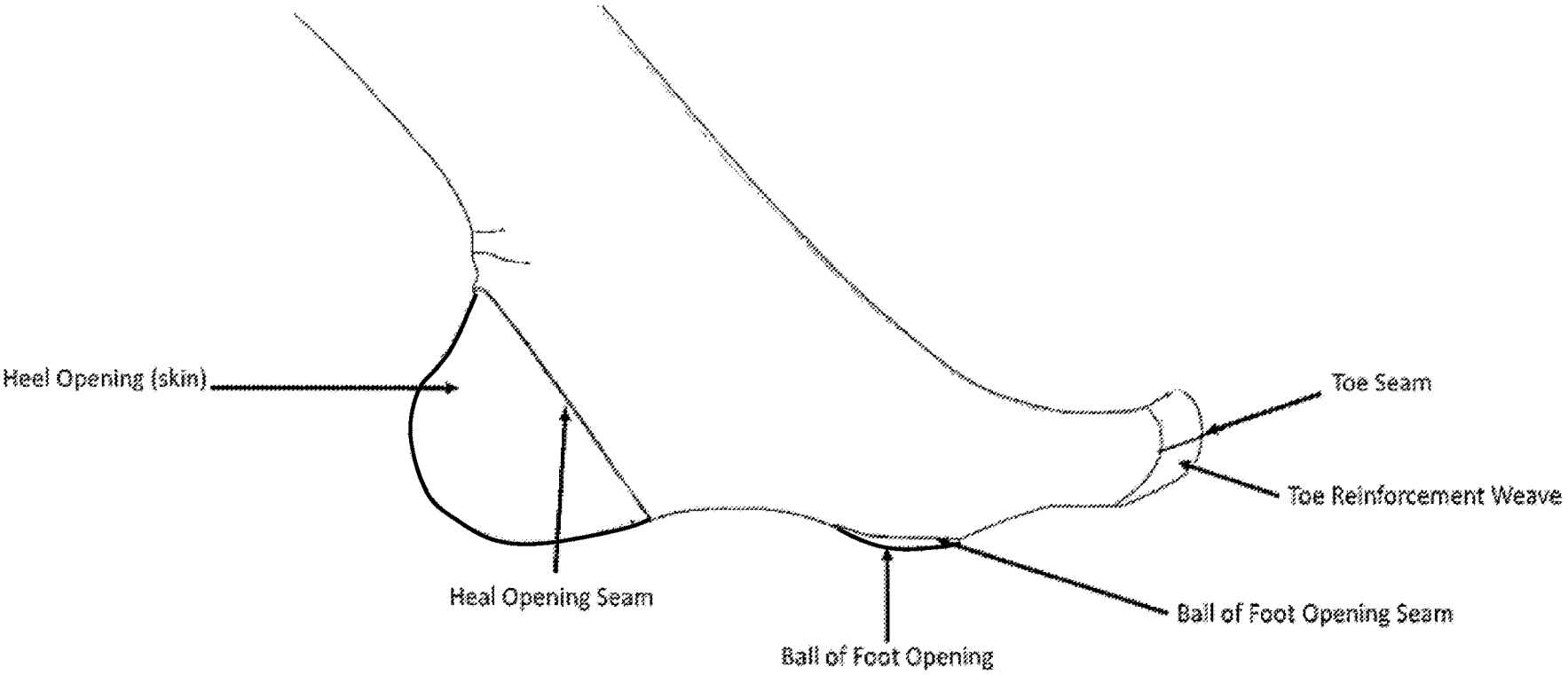
FIG. 9A shows a side outer view of the foot of the tights of a garment in accordance with the embodiments of the subject invention.
Figure 9B:
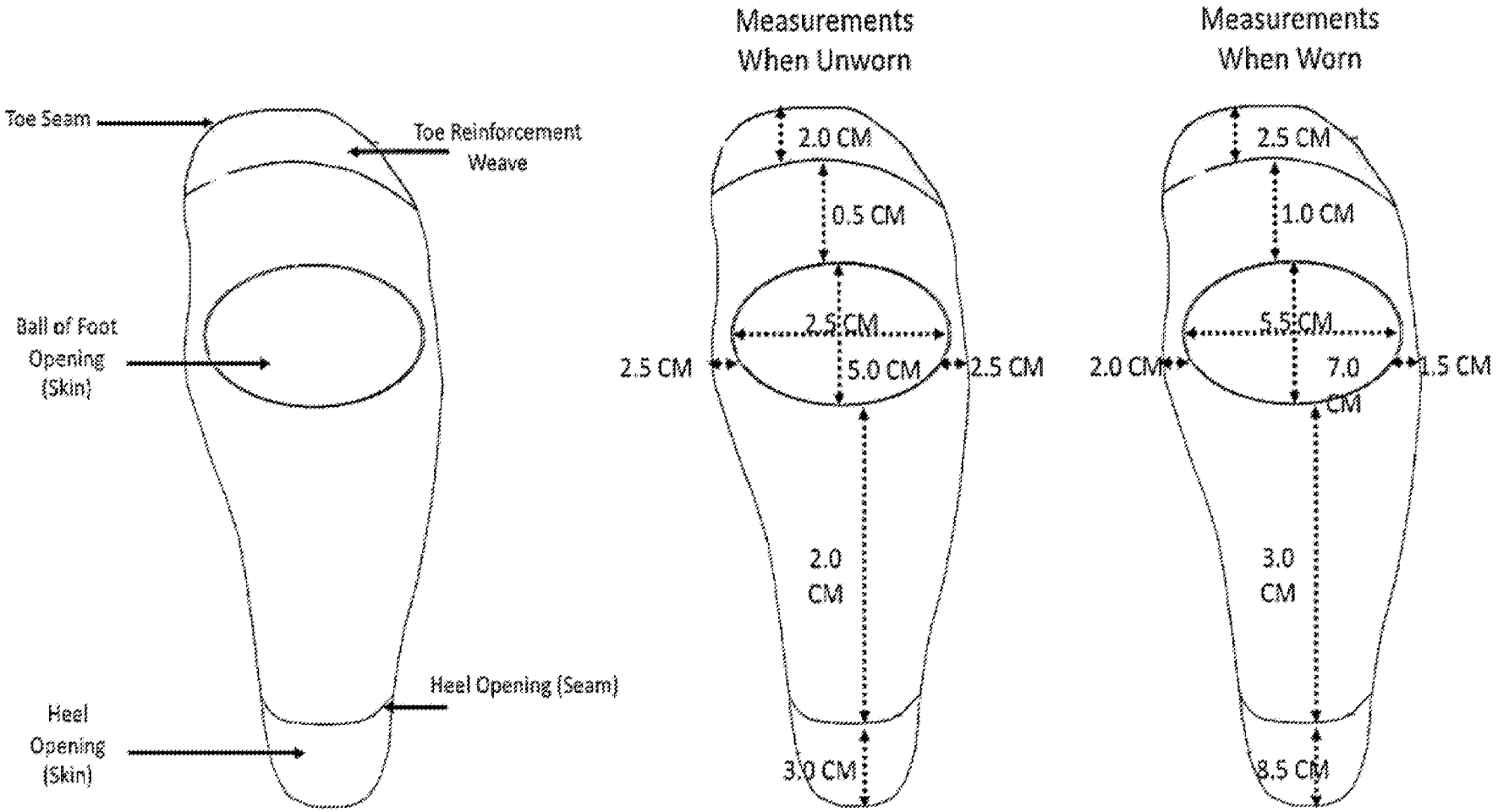
FIG. 9B shows a bottom outer view of the foot of the tights with worn and unworn measurements of a garment in accordance with embodiments of the subject invention.

Referring to FIGS. 9A and 9B, embodiments of the subject tights locate the underfoot cut-outs to allow the dancer to overcome the disadvantages associated with the lack of traction needed for a dancer to fully articulate the foot within a pointe shoe. Embodiments of the tights locate the cut-out opening at the ball of the foot and heel to allow the dancer to not only have quick access to the parts of the foot they need to tend to without undressing (taking tights off), such that the distal end of the tights can be pulled over the foot to expose the foot. The cutout opening also allow the dancers to feel the shoe and allow the traction needed to better articulate the foot (FIGS. 9A and 9B). The subject tights shown in FIGS. 91 and 9B expand the bottom of the foot opening to include the ball of the dancer's foot and add a cut-out at the heel to reduce the slipping of the foot inside the pointe shoe. This reduces painful blistering that can lead to dangerous infections. Embodiments can incorporate a silicon grip.

Current tights typically have a shape that has a square cut in the area of the toes (distal end of foot portion) that results in excess material on both sides of the toe/ball of foot areas. This surplus of material results in too much material on either side of the foot that can cause unwanted additional tightness inside pointe shoes, as well as potentially creating unnecessary painful blistering within that area.

Embodiments of the subject tights provide a reinforced toe area seam such that the shape of the reinforced toe area seam follows the natural curvature of the toes (FIGS. 9A and 9B). The subject tights utilize a smaller flat seam for additional comfort in this area that sustains hours of pounding pressure endured daily. By doing so, the subject tights reduce the slipping of the foot inside the pointe shoe, which reduces painful blistering that can lead to dangerous infections.

FIGS. 10A-10B shows the measurements of specific embodiments of the subject tights at rest (unworn) (FIG. 10A) and in an elongated state (FIG. 10B), where the elongate state is reach by a machine run stretchability testing of the tights that stretches the tights an amount that will not damage the tights or diminish the tights ability to return to rest position.

Figure 11A:
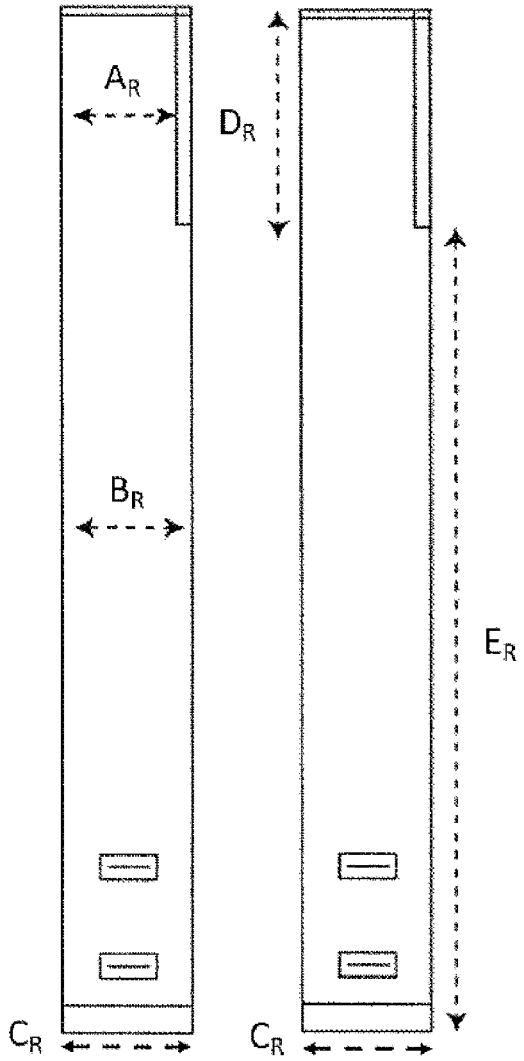
FIG. 11A shows diagrams representing the leg and foot portions at rest (unworn unstretched) measurements of various size garments in accordance with the embodiments of the subject invention.
Figure 11B:
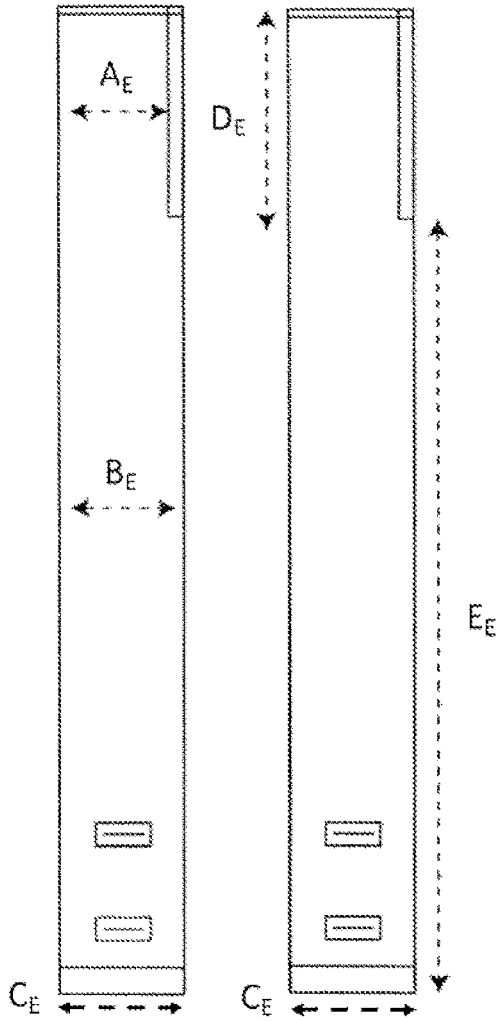
FIG. 11B shows diagrams representing the leg and foot portions elongated measurements derived from the manufacturer's machine-run stretchability testing of various size garments in accordance with the embodiments of the subject invention.

FIGS. 11A and 11B show the measurements of leg and foot dimensions of various size tight, at rest (FIG. 11A) and in the elongated state (FIG. 11B), via the same stretchability test.

Figure 12:
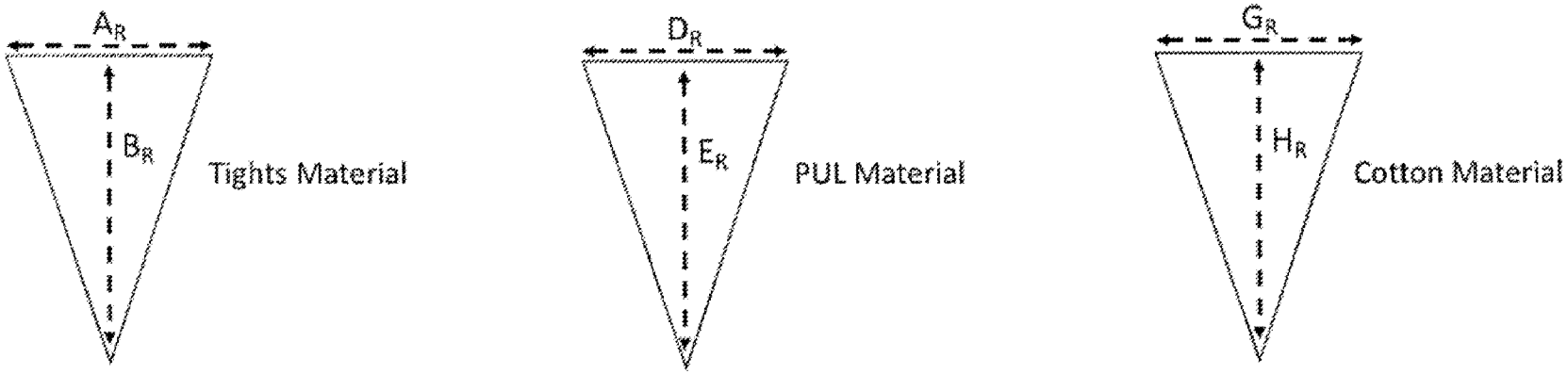
FIG. 12 shows diagrams representing the panty portion of the G-String (Option 1) at rest (unworn, unstretched) measurements of various size garments in accordance with embodiments of the subject invention where elongated measurements are not provided because the panty layers are not meant to be used on their own or to be stretched when worn during use.

FIGS. 12 and 13 show the measurements of the panty section of various size tights, where FIG. 12 shows the dimensions for the G-string option panty panel and FIG. 13 shows the dimensions for the Cheeky Option panty panel. The stretchability test was not conducted for these panty panels, as these panty panels are designed to not appreciably stretch under normal use.

Current tights utilize a weave where components of the fibers in the weave affect the perceived color of the tights when worn by the dancer. The choice of color, shade and opacity can lead to better aesthetics under stage lights. Certain colors can make the dancer's legs less vibrant, resulting in a loss of the appearance of toned legs and an unwanted greyish tone. During performance, it is standard for studios/companies to dictate the color and make of tights to achieve the uniformity of the appearance of the dancers' legs on stage. Thus, the color selections of tights in the current market are not ideal for use with varied skin tones if the goal is to achieve the desired uniformity of appearance.

Embodiments of the subject tights can come in multiple colors, including a pantone color, such that multiple dancers having different skin colors can wear different color tights, such that a desired uniformity of color is perceived when the dancers perform.

Embodiments

Embodiment 1. Ballet tights, comprising:

two leg portions, each having a bottom leg portion opening and a top leg portion opening;

two corresponding foot portions, each positioned at a distal end of the ballet tights and each having a foot portion opening, where each foot portion is positioned at a distal end of a corresponding leg portion, such that the bottom leg portion opening of the leg portion transitions to the foot portion opening of the foot portion;

a lower torso portion;

wherein the lower torso portion is positioned near a proximal end of each of the two leg portions and transitions to the proximal end of each of the two leg portions;

a waistband portion, wherein the waistband portion is positioned at a top of the ballet tights, and has a top waistband portion opening and a bottom waist portion opening;

a panty portion;

wherein the panty portion is positioned near a proximal end of each of the two leg portions, and is interconnected to the two leg portions, the waistband portion, and the lower torso portion via one or more seams, wherein the two leg portions, the lower torso portion, and the two foot portions are constructed of a first fabric, wherein the first fabric is formed by a tights weave of a first yarn, where the first yarn is formed by a spandex fiber core covered in nylon.

Embodiment 2. The ballet tights according to embodiment 1, wherein the nylon has a denier of 20 and 24 filaments, and the spandex fiber core has a denier of 20, to create a 20/20/24 yarn.

Embodiment 3. The ballet tights according to embodiment 1, wherein the nylon has a denier of 35-45 and 32-36 filaments, and the spandex fiber core has a denier of 20, to create a 20/(35-45)/(32-36) yarn.

Embodiment 4. The ballet tights according to embodiment 3, wherein the tights weave is 10-15% spandex and 85-90% nylon.

Embodiment 5. The ballet tights according to embodiment 3, wherein the tights weave is 13-14% spandex and 86-87% nylon.

Embodiment 6. The ballet tights according to embodiment 1, wherein the nylon has a denier of 40 and 34 filaments, and the spandex fiber core has a denier of 20, to create a 20/40/34 yarn.

Embodiment 7. The ballet tights according to any preceding embodiments, wherein the tights weave is a weft jersey knit.

Embodiment 8. The ballet tights according to any preceding embodiments, wherein the tights weave is a circular continuous weave.

Embodiment 9. The ballet tights according to any preceding embodiments, wherein the one or more seams comprise a pair of seams, wherein the pair of seams is formed by a left seam and a right seam, and the pair of seams are configured in a generally V shape in a front of the panty portion, such that a width between the left seam and the right seam decreases from a proximal end of the panty portion to a distal end of the panty portion.

Embodiment 10. The ballet tights according to embodiment 9,
wherein the left seam connects the panty portion to the left leg portion, and to the lower torso portion, and
wherein the right seam connects the panty portion to the right leg portion and to the lower torso portion.

Embodiment 11. The ballet tights according to embodiment 9,
wherein the left seam and the right seam are a flat seams.

Embodiment 12. The ballet tights according to any preceding embodiments,
wherein the panty portion is connected to the waistband via a panty top seam.

Embodiment 13. The ballet tights according to any preceding embodiments,
wherein the lower torso portion is connected to the waistband via a waist seam.

Embodiment 14. The ballet tights according to any preceding embodiments,
wherein, when the ballet tights are worn by a female dancer, the panty portion covers an area having a size and location of most female vaginas in length and width.

Embodiment 15. The ballet tights according to any preceding embodiments,
wherein, when the ballet tights are worn by a female dancer, the panty portion is at least 23 cm long and the panty portion is at least 8 cm wide at a top of the panty portion.

Embodiment 16. The ballet tights according to embodiment 9,
wherein, when the ballet tights are worn by the female dancer, the pair of seams follow a natural shape of most female's genitalia.

Embodiment 17. The ballet tights according to any preceding embodiments,
wherein the panty portion comprises:
an inner layer;
an intermediate layer; and
an outer layer,
wherein, when the ballet tights are worn by a female dancer, the inner layer is between the intermediate layer and the dancer, and the intermediate layer is between the inner layer and the outer layer,
wherein the inner layer is sufficiently absorbent to absorb discharge and liquids that are naturally excreted by a female dancer, and
wherein the intermediate layer is waterproof and breathable, so as to prevent moisture from absorbed by the inner layer to leak through to the outer layer.

Embodiment 18. The ballet tights according to embodiment 17,
wherein the inner layer incorporates a first panty fabric that is made of cotton mix; and
wherein the intermediate layer incorporates a second panty fabric is made of a PUL.

Embodiment 19. The ballet tights according to embodiment 17,
wherein the cotton mix is 45-55% cotton and 55-45% polyester.

Embodiment 20. The ballet tights according to embodiment 17,
wherein the cotton mix is 49-51% cotton and 51-49% polyester.

Embodiment 21. The ballet tights according to any preceding embodiments,
wherein the panty portion has a G-string cut shape in a rear of ballet tights.

Embodiment 22. The ballet tights according to embodiment 21,
wherein, when the ballet tights are worn by a female dancer, the panty portion having the G-string cut shape in the rear of ballet tights reduces seam pressure in an anal area of the dancer.

Embodiment 23. The ballet tights according to any preceding embodiments,
wherein, when the ballet tights are worn by a female dancer, the panty portion is visibly exposed.

Embodiment 24. The ballet tights according to any preceding embodiments,
wherein the panty portion has a rear cheeky portion in a rear of ballet tights.

Embodiment 25. The ballet tights according to embodiment 24,
wherein, when the ballet tights are worn by a female dancer, the panty portion having the rear cheeky portion in the rear of ballet tights reduces seam pressure in an anal area of the dancer.

Embodiment 26. The ballet tights according to embodiment 24,
wherein the lower torso portion is seamed to the rear cheeky portion via two rear seams of the one or more seams.

Embodiment 27. The ballet tights according to any preceding embodiments,
wherein the waistband portion does not incorporate an elastic waistband.

Embodiment 28. The ballet tights according to any preceding embodiments,
wherein the waistband is formed by a 1×3 rib knit weave.

Embodiment 29. The ballet tights according to embodiment 28,
wherein the 1×3 rib knit weave is of the first yarn.

Embodiment 30. The ballet tights according to any preceding embodiments,
wherein the lower torso portion comprises a waist reinforcement weave adjacent to, and seamed to, the waistband portion.

Embodiment 31. The ballet tights according to embodiment 30,
wherein the waist reinforcement weave is a 1×1 rib knit weave.

Embodiment 32. The ballet tights according to any preceding embodiments,
wherein the two foot portions each comprise:
a heel cut-out,
wherein the heel cut-out allows a dancer to obtain sufficient friction between a foot of the dancer and a pointe shoe worn by the dancer; and
a ball-of-foot cut out,
wherein the ball of foot cut out allows a dancer to obtain sufficient friction between afoot of the dancer and the pointe shoe worn by the dancer, and
wherein the ball-of-foot cut out allows a dancer to access the dancer's foot without removing the corresponding leg portion.

Embodiment 33. The ballet tights according to any preceding embodiments, wherein a distal end of the foot portion comprises a toe reinforcement that transitions to the tights weave of the foot portion via weave transitioning.

Embodiment 34. The ballet tights according to embodiment 33, wherein the toe reinforcement weave is a 1×1 rib knit weave.

Embodiment 35. The ballet tights according to embodiment 33, wherein the toe reinforcement weave seams to itself at the distal end of the foot portion.

Embodiment 36. The ballet tights according to any preceding embodiments, wherein each foot portion has a construction at a toe/ball portion of the foot portion follows a natural shape of an average female's toes by rounding off corner of the foot portion, and incorporating a flat seam.

Embodiment 37. The ballet tights according to any preceding embodiments, wherein the first yarn is selectable from multiple identifiers first yearn colors, where the multiple identified first yarn colors are associated with a corresponding multiple identified skin colors/tones, such that each dancer of multiple dancers having the corresponding multiple identified skin colors/tones can each wear a corresponding ballet tights having the identical first yarn color of the multiple identified first yarn colors associated with the dancer's skin color/tones, so that, when the multiple ballet tights are worn by the multiple dancers, all of the dancers of the multiple dancers have a perceived tights color as perceived by a member of an audience that is within a predetermined range of a target perceived tights color.

Embodiment 38. The ballet tights according to any preceding embodiments, wherein the lower torso portion comprises a panty reinforcement weave adjacent to, and seamed to, a segment of the panty portion.

Embodiment 39. The ballet tights according to embodiment 38, wherein the panty reinforcement weave transitions to the tights weave of the lower torso portion via weave transitioning.

Embodiment 40. The ballet tights according to embodiment 38, wherein the panty reinforcement weave is a 1×1 rib knit weave.

Embodiment 41. The ballet tights according to any preceding embodiments, wherein the one or more seams are flat seams.

Embodiment 42. The ballet tights according to any preceding embodiments, wherein the nylon is selected from nylon 6 and nylon 6,6.

Embodiment 43. The ballet tights according to embodiment 42, wherein the nylon is nylon 6,6.

Embodiment 44. The ballet tights according to embodiment 42, wherein the nylon is nylon 6.

Embodiment 45. Ballet tights, comprising:

two leg portions, each having a bottom leg portion opening and a top leg portion opening;

a lower torso portion;

wherein the lower torso portion is positioned near a proximal end of each of the two leg portions and transitions to the proximal end of each of the two leg portions;

a panty portion;

wherein the panty portion is positioned near a proximal end of each of the two leg portions, and is interconnected to the two leg portions, and the lower torso portion via one or more seams, wherein the two leg portions, and the lower torso portion are constructed of a first fabric, wherein the one or more seams comprise a pair of seams, wherein the pair of seams is formed by a left seam and a right seam, and the pair of seams are configured in a generally V shape in a front of the panty portion, such that a width between the left seam and the right seam decreases from a proximal end of the panty portion to a distal end of the panty portion.

Embodiment 46. The ballet tights according to embodiment 45, wherein the left seam connects the panty portion to the left leg portion, and to the lower torso portion, and wherein the right seam connects the panty portion to the right leg portion and to the lower torso portion.

Embodiment 47. The ballet tights according to embodiment 45, wherein the left seam and the right seam are a flat seams.

Embodiment 48. The ballet tights according to embodiment 45, further comprising:

a waistband portion, wherein the waistband portion is positioned at a top of the ballet tights, and has a top waistband portion opening and a bottom waist portion opening;

wherein the panty portion is connected to the waistband via a panty top seam

Embodiment 49. The ball of tights according to embodiment 45, wherein the lower torso portion is connected to the waistband via a waist seam.

Embodiment 50. The ballet tights according to embodiment 45, wherein, when the ballet tights are worn by a female dancer, the panty portion covers an area having a size and location of most female vaginas in length and width.

Embodiment 51. The ballet tights according to embodiment 45, wherein, when the ballet tights are worn by a female dancer, the panty portion is at least 23 cm long and the panty portion is at least 8 cm wide at a top of the panty portion.

Embodiment 52. The ballet tights according to embodiment 45, wherein, when the ballet tights are worn by the female dancer, the pair of seams follow a natural shape of most female's genitalia.

Embodiment 53. The ballet tights according to embodiment 45, wherein the panty portion comprises:

an inner layer;

an intermediate layer; and an outer layer, wherein, when the ballet tights are worn by a female dancer, the inner layer is between the intermediate layer and the dancer, and the intermediate layer is between the inner layer and the outer layer, wherein the inner layer is sufficiently absorbent to absorb discharge and liquids that are naturally excreted by a female dancer, and wherein the intermediate layer is waterproof and breathable, so as to prevent moisture from absorbed by the inner layer to leak through to the outer layer.

Embodiment 54. The ballet tights according to embodiment 53, wherein the inner layer incorporates a first panty fabric that is made of cotton mix; and wherein the intermediate layer incorporates a second panty fabric is made of a PUL.

Embodiment 55. The ballet tights according to embodiment 53, wherein the cotton mix is 45-55% cotton and 55-45% polyester.

Embodiment 56. The ballet tights according to embodiment 53, wherein the cotton mix is 49-51% cotton and 51-49% polyester.

Embodiment 57. The ballet tights according to embodiment 45, wherein the panty portion has a G-string cut shape in a rear of ballet tights.

Embodiment 58. The ballet tights according to embodiment 57, wherein, when the ballet tights are worn by a female dancer, the panty portion having the G-string cut shape in the rear of ballet tights reduces seam pressure in an anal area of the dancer.

Embodiment 59. The ballet tights according to embodiment 45, wherein, when the ballet tights are worn by a female dancer, the panty portion is visibly exposed.

Embodiment 60. The ballet tights according to embodiment 45, wherein the panty portion has a rear cheeky portion in a rear of ballet tights.

Embodiment 61. The ballet tights according to embodiment 60, wherein, when the ballet tights are worn by a female dancer, the panty portion having the rear cheeky portion in the rear of ballet tights reduces seam pressure in an anal area of the dancer.

Embodiment 62. The ballet tights according to embodiment 60, wherein the lower torso portion is seamed to the rear cheeky portion via two rear seams of the one or more seams.

Embodiment 63. Ballet tights, comprising:

two leg portions, each having a bottom leg portion opening and a top leg portion opening;

a lower torso portion;

wherein the lower torso portion is positioned near a proximal end of each of the two leg portions and transitions to the proximal end of each of the two leg portions;

a waistband portion, wherein the waistband portion is positioned at a top of the ballet tights, and has a top waistband portion opening and a bottom waist portion opening;

a panty portion;

wherein the panty portion is positioned near a proximal end of each of the two leg portions, and is interconnected to the two leg portions, the waistband portion, and the lower torso portion via one or more seams, wherein the two leg portions, the lower torso portion, and the two foot portions are constructed of a first fabric, wherein the waistband portion does not incorporate an elastic waistband.

Embodiment 64. The ballet tights according to embodiment 63, wherein the panty portion is connected to the waistband via a panty top seam.

Embodiment 65. The ballet tights according to embodiment 63, wherein the lower torso portion is connected to the waistband via a waist seam.

Embodiment 66. The ballet tights according to embodiment 63, wherein the first fabric is formed by a tights weave of a first yarn, where the first yarn is formed by a spandex fiber core covered in nylon wherein the waistband is formed by a 1×3 rib knit weave.

Embodiment 67. The ballet tights according to embodiment 66, wherein the 1×3 rib knit weave is of the first yarn.

Embodiment 68. The ballet tights according to embodiment 63, wherein the lower torso portion comprises a waist reinforcement weave adjacent to, and seamed to, the waistband portion.

Embodiment 69. The ballet tights according to embodiment 68, wherein the first fabric is formed by a tights weave of first yarn, where the first yarn is formed by a spandex fiber core covered in nylon;

wherein the waist reinforcement weave is a 1×1 rib knit weave.

Embodiment 70. Ballet tights, comprising:

two leg portions, each having a bottom leg portion opening and a top leg portion opening;

two corresponding foot portions, each positioned at a distal end of the ballet tights and each having a foot portion opening, where each foot portion is positioned at a distal end of a corresponding leg portion, such that the bottom leg portion opening of the leg portion transitions to the foot portion opening of the foot portion;

wherein the two foot portions each comprise:

a heel cut-out, wherein the heel cut-out allows a dancer to obtain sufficient friction between a foot of the dancer and a pointe shoe worn by the dancer; and a ball-of-foot cut out, wherein the ball of foot cut out allows a dancer to obtain sufficient friction between afoot of the dancer and the pointe shoe worn by the dancer, and wherein the ball-of-foot cut out allows a dancer to access the dancer's foot without removing the corresponding leg portion.

Embodiment 71. The ballet tights according to embodiment 70, wherein the two leg portions, and the two foot portions are constructed of a first fabric.

Embodiment 72. The ballet tights according to embodiment 70, wherein the first fabric is formed by a tights weave of a first yarn, where the first yarn is formed by a spandex fiber core covered in nylon.

Embodiment 73. The ballet tights according to embodiment 70, wherein a distal end of the foot portion comprises a toe reinforcement that transitions to the tights weave of the foot portion via weave transitioning.

Embodiment 74. The ballet tights according to embodiment 73, wherein the toe reinforcement weave is a 1×1 rib knit weave.

Embodiment 75. The ballet tights according to embodiment 73, wherein the toe reinforcement weave seams to itself at the distal end of the foot portion.

Embodiment 76. The ballet tights according to embodiment 70, wherein each foot portion has a construction at a toe/ball portion of the foot portion follows a natural shape of an average female's toes by rounding off corner of the foot portion, and incorporating a flat seam.

The invention claimed is:

1. A garment configured to be worn during a performance, the garment comprising:

a leg portion comprising a proximal end and a distal end;

a foot portion comprising a proximal end that transitions into the distal end of the leg portion;

a lower torso panel comprising a front side, a rear side, and a distal end that transitions via knitting into the proximal end of the leg portion;

a G-string seam arranged at a rear side of the garment and comprising a proximal end and a distal end, wherein the rear side of the lower torso panel is attached to the G-string seam between the proximal end and the distal end of the G-string seam;

a waistband comprising a distal end that is interconnected to a proximal end of the lower torso panel and to the proximal end of the G-string seam; and a panty panel comprising a "V"-shape assembly having a width that is wider at a proximal end of the panty panel and narrower at a distal end of the panty panel, wherein the proximal end of the panty panel is interconnected to the distal end of the waistband at a front side of the waistband and the narrower distal end of the panty panel is connected to the distal end of the G-string seam at the rear side of the garment.

2. The garment, according to claim 1, wherein the leg portion, the foot portion, and the lower torso panel are knitted from a first yarn comprising an elastane fiber core wrapped in nylon filament.

3. The garment according to claim 2, wherein the nylon has a denier of 20 and 24 filaments, and the elastane fiber core has a denier of 20, to define a 20/20/24 yarn.

4. The garment, according to claim 2, wherein the nylon has a denier of 35-45 and 32-36 filaments, and the elastane fiber core has a denier of 20, to define a 20/(35-45)/(32-36) yarn.

5. The garment, according to claim 4, wherein the garment knit is 10-15% elastane and 85-90% nylon.

6. The garment, according to claim 4, wherein the garment knit is 13-14% elastane and 86-87% nylon.

7. The garment, according to claim 4, wherein the nylon has a denier of 40 and 34 filaments, and the elastane fiber has a denier of 20, to define a 20/40/34 yarn.

8. The garment, according to claim 3, wherein the nylon is selected from nylon 6 and nylon 6,6.

9. The garment, according to claim 8, wherein the nylon is nylon 6,6.

10. The garment, according to claim 8, wherein the nylon is nylon 6.

11. The garment, according to claim 2, wherein the garment knit is a weft jersey knit.

12. The garment according to claim 2, wherein the garment knit is a circular continuous knit.

13. The garment, according to claim 1, wherein a side of the panty panel is connected to the front side of the lower torso panel and to the proximal end of the leg portion with a seam.

14. The garment, according to claim 13, wherein the seam that connects the panty panel to the lower torso panel and to the lea portion is a flat seam.

15. The garment, according to claim 13, wherein the seam that connects the panty panel to the lower torso panel and to the leg portion comprises a panty reinforcement knit.

16. The garment, according to claim 15, wherein the panty reinforcement knit comprises a first yarn that is configured to be more stretchable than a knit of the lea portion and a knit of the lower torso panel.

17. The garment, according to claim 16, wherein the panty reinforcement knit is a 1×1 rib knit.

18. The garment, according to claim 1, wherein the panty panel is connected to the waistband with a flat seam.

19. The garment, according to claim 1, wherein the lower torso panel is connected to the waistband with a flat seam comprising an elasticity that is greater than an elasticity of the leg portion and less than an elasticity of the waistband.

20. The garment, according to claim 1, wherein the panty panel is at least 23 cm long between the panty panel proximal end and the panty panel distal end and is at least 8 cm wide at the panty panel proximal end.

21. The garment, according to claim 1, wherein the panty panel comprises: an inner layer of an absorbent material; and an intermediate layer exterior to the inner layer, the Intermediate laver comprising a waterproof material.

22. The garment, according to claim 21, wherein the inner layer comprises a cotton mix; and wherein the intermediate layer comprises at least one of polyurethane and a polyurethane laminate (PUL).

23. The garment, according to claim 22, wherein the cotton mix is 45-55% cotton and 55-45% polyester.

24. The garment, according to claim 22, wherein the cotton mix is 49-51% cotton and 51-49% polyester.

25. The garment, according to claim 21, comprising an outer layer exterior to the intermediate laver, wherein the outer layer defines the lower torso panel.

26. The garment, according to claim 21, comprising an outer layer that either (i) defines the lower torso panel, or (ii) is a separate layer of material joined to the lower torso panel.

27. The garment, according to claim 1, wherein the G-string seam at the rear side of the garment comprises a zig-zag stitch.

28. The garment, according to claim 27, wherein the zig-zag stitch forms angles with the axis of the G-string seam that are between 30°-60°.

29. The garment, according to claim 28, wherein the zig zag stitch is about 7 mm in width and is configured to be reduced to 6 mm in width when being worn.

30. The garment, according to claim 28, further comprising an elastic strip attached to the rear side of the lower torso panel and on an interior of the lower torso panel, such that the zig-zag stitch IS configured to stretch with the elastic strip and is configured to uplift a buttocks.

31. The garment, according to claim 1, wherein the panty panel has a rear cheeky portion in the rear side of the garment.

32. The garment, according to claim 31, wherein, when the garment is worn by a female dancer, the panty panel having the rear cheeky portion in the rear side of the garment reduces seam pressure in an anal area of the dancer.

33. The garment, according to claim 31, wherein the lower torso is seamed to the rear cheeky portion via two rear seams.

34. The garment, according to claim 1, wherein the waistband is formed by a 1×3 rib knit.

35. The garment, according to claim 34, wherein the 1×3 rib knit comprises a first yarn that has an elastane fiber core wrapped in nylon.

36. The garment, according to claim 1, wherein the lower torso panel is interconnected to the waistband with a waist reinforcement knit.

37. The garment, according to claim 36, wherein the waist reinforcement knit is a 1×1 rib knit.

38. The garment, according to claim 1, wherein the foot portion comprises—at least one cut-out that is configured to expose at least one of a heel and a ball of foot and wherein an edge of the at least one cut-out comprises a flat seam.

39. The garment, according to claim 1, further comprising a toe reinforcement region that transitions via knitting to the distal end of the foot portion.

40. The garment, according to claim 39, wherein the toe reinforcement region transitions with a 1×1 rib knitting.

41. The garment, according to claim 39, wherein the toe reinforcement region is closed at a distal end of the toe reinforcement region with a flat seam.

42. The garment, according to claim 41, wherein the flat seam forms a curve at the distal end of the toe reinforcement region, such that the toe reinforcement region is rounded and configured to follow a toe curvature.

43. A garment comprising: two leg portions, each leg portion comprising respective proximal ends and respective distal ends; two foot portions, each foot portion comprising respective proximal ends that transition into the respective distal ends of the two leg portions and each foot portion further comprising respective distal ends that transition into toe reinforcement regions; at least one cut-out in each of the two foot portions, wherein the at least one cut-out in each of the two foot portions is configured to expose at least one of a heel of a foot and a ball of the foot; a lower torso panel comprising a proximal end and a distal end, wherein the distal end of the lower torso panel transitions into the proximal ends of the respective leg portions; a waistband having a distal end and comprising an elasticity that is less than an elasticity of the leg portions and the foot portions; a reinforcement knit that transitions the proximal end of the lower torso panel with the distal end of the waistband, wherein the reinforcement knit comprises an elasticity that is less than the elasticity of the waistband and more than an elasticity of the lower torso panel; and a panty panel having sides that form a "V"-shape assembly with a proximal end and a distal end, wherein the panty panel proximal end is wider than the panty panel distal end and wherein the panty panel sides are connected by a panty reinforcement knit to the lower torso panel and to the proximal ends of the leg portions.

44. The garment, according to claim 43, wherein the distal ends of the toe reinforcement regions are closed with respective flat seams.

45. The garment, according to claim 44, wherein the flat seams are curved and configured to go around toes of the respective foot.

46. The garment, according to claim 43, wherein the at least one cut-out in the foot portions are configured to expose an area of the heel from behind an arch of the respective foot to a back of the respective foot below a respective ankle.

47. The garment, according to claim 43, further comprising a G-string seam at a rear side of the garment, the G-string seam having a proximal end that attaches to the waistband and a distal end that attaches to the distal end of the panty panel.

48. The garment, according to claim 47, wherein the lower torso panel comprises rear sides that are joined at the rear side of the garment adjacent the G-string seam.

49. The garment, according to claim 48, wherein G-string seam comprises a zig-zag stitch that forms angles with the axis of the G-string seam that are between 30°-60°.

50. The garment, according to claim 49, further comprising an elastic strip attached to the rear side of the garment and on an interior of the lower torso panel, such that the zig-zag stitch is configured to stretch with the elastic strip and is configured to uplift a buttocks.

51. The garment, according to claim 43, wherein the panty panel comprises an inner layer of one or more absorbent materials and an intermediate layer exterior to the inner layer, the intermediate laver comprising a waterproof material.

* * * * *